US007692601B2

(12) United States Patent
Bisiules et al.

(10) Patent No.: US 7,692,601 B2
(45) Date of Patent: Apr. 6, 2010

(54) DIPOLE ANTENNAS AND COAXIAL TO MICROSTRIP TRANSITIONS

(75) Inventors: Peter John Bisiules, LaGrange Park, IL (US); John Coult, Chicago, IL (US); Ching-Shun Yang, Wheaton, IL (US); Joselito de la Cruz Gavilan, Bolingbrook, IL (US); Gang Yi Deng, Irvine, CA (US); John Stewart Wilson, Downers Grove, IL (US)

(73) Assignee: Andrew LLC, Westchester, IL (US)

( * ) Notice: Subject to any disclaimer, the term of this patent is extended or adjusted under 35 U.S.C. 154(b) by 779 days.

(21) Appl. No.: 10/529,677

(22) PCT Filed: Nov. 13, 2003

(86) PCT No.: PCT/US03/36256

§ 371 (c)(1),
(2), (4) Date: Feb. 28, 2006

(87) PCT Pub. No.: WO2004/055938

PCT Pub. Date: Jul. 1, 2004

(65) Prior Publication Data

US 2008/0111757 A1 May 15, 2008

Related U.S. Application Data

(60) Provisional application No. 60/433,352, filed on Dec. 13, 2002.

(51) Int. Cl.
*H01Q 9/16* (2006.01)
*H01Q 21/26* (2006.01)

(52) U.S. Cl. ..... 343/803; 343/797; 343/799; 343/805; 343/806

(58) Field of Classification Search ..... None
See application file for complete search history.

(56) References Cited

U.S. PATENT DOCUMENTS

| | | | | |
|---|---|---|---|---|
| 3,680,135 | A | 7/1972 | Boyer | |
| 3,771,162 | A * | 11/1973 | Dienes | 343/806 |
| 4,115,778 | A | 9/1978 | Snow | |
| 4,555,708 | A | 11/1985 | Waineo et al. | |
| 6,313,809 | B1 * | 11/2001 | Gabriel et al. | 343/797 |
| 6,333,720 | B1 | 12/2001 | Gottl et al. | |

(Continued)

OTHER PUBLICATIONS

International Search Report PCT/US03/36256.

*Primary Examiner*—Trinh V Dinh
(74) *Attorney, Agent, or Firm*—Husch Blackwell Sanders LLP Welsh & Katz

(57) ABSTRACT

The invention relates in part to a folded dipole having a dipole axis and a pair of arms which together have a profile which is concave on one side and convex on the other when viewed along the dipole axis. The dipoles may be arranged as a dipole box around a central region, typically in a generally circular or square configuration. Further elements may be placed in the dipole box or in the gaps between dipole boxes. The antenna may be a single-band antenna, or a multi-band antenna with the further elements operating in a different frequency band to the dipole boxes. The further elements may be concentric dipole boxes. The invention is particularly suited for use in a cellular base station panel antenna. A novel coaxial to microstrip transition is also described.

20 Claims, 35 Drawing Sheets

U.S. PATENT DOCUMENTS 6,573,874 B1 * 6/2003 Saito et al. ..... 343/805
6,741,220 B2 * 5/2004 Inoue ..... 343/797
6,831,615 B2 * 12/2004 Gottl ..... 343/797

* cited by examiner

Figure 7C
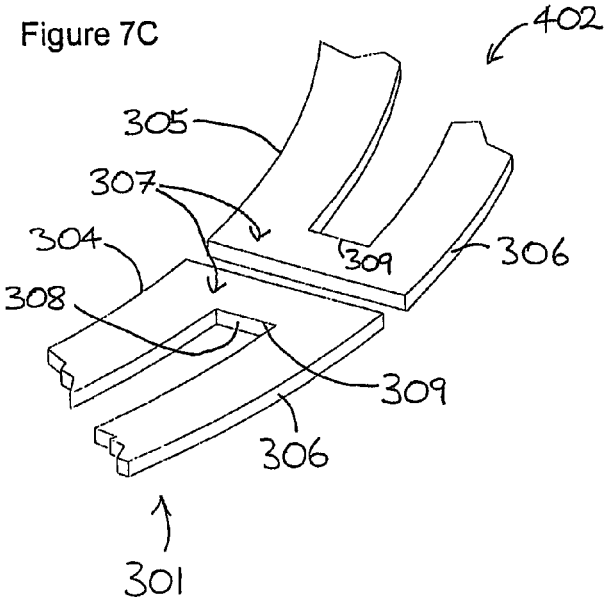
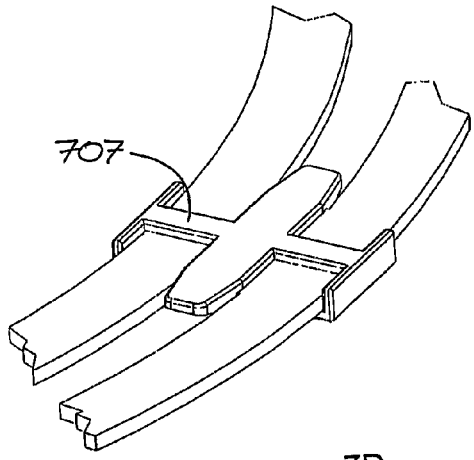
Figure 7D

DIPOLE ANTENNAS AND COAXIAL TO MICROSTRIP TRANSITIONS

CROSS-REFERENCE TO RELATED APPLICATIONS

This application claims the benefit of priority from U.S. application Ser. No. 10/390,487, filed on Mar. 17, 2003, entitled Folded Dipole Antenna, Coaxial To Microstrip Transition, And Retaining Element, now issued as U.S. Pat. No. 6,822,618 on Nov. 23, 2004, and claims the benefit of priority from U.S. Provisional Patent Application Ser. No. 60/433,352, filed on Dec. 13, 2002, entitled Improvements Relating To Dipole Antennas. Provisional Patent Application Ser. No. 60/433,352 is incorporated herein by reference in its entirety.

FIELD OF THE INVENTION

The present invention relates to a folded dipole, a dipole box, an antenna incorporating an array of dipole boxes, a method of manufacturing a dipole, and an electrically insulating element for retaining together a pair of dipoles. The invention also relates to a coaxial to microstrip transition All aspects of the invention are typically but not exclusively for use in wireless terrestrial mobile communications systems

BACKGROUND OF THE INVENTION

In some wireless communication systems, single band array antennas are employed. However in many modern wireless communication systems network operators wish to provide services under existing mobile communication systems as well as emerging systems. In Europe GSM and DCS1800 systems currently coexist and there is a desire to operate emerging third generation systems (UMTS) in parallel with these systems. In North America network operators wish to operate AMPS/NADC, PCS and third generation systems in parallel.

As these systems operate within different frequency bands separate radiating elements are required for each band. To provide dedicated antennas for each system would require an unacceptably large number of antennas at each site. It is thus desirable to provide a compact antenna within a single structure capable of servicing all required frequency bands.

Base station antennas for cellular communication systems generally employ array antennas to allow control of the radiation pattern, particularly down tilt. Due to the narrow band nature of arrays it is desirable to provide an individual array for each frequency range. When antenna arrays are interleaved in a single antenna structure the radiating elements must be arranged within the physical geometrical limitations of each array whilst minimising undesirable electrical interactions between the radiating elements.

U.S. Pat. No. 6,211,841 discloses a dual band cellular base station antenna in which a high frequency band array of cross dipoles is interleaved with a low frequency band array of cross dipoles.

U.S. Pat. No. 6,333,720 discloses a dual polarized dual band antenna. An array of two low frequency band dipole squares are mounted above a ground plane. Dipole feeds angle outwardly from the centre of each group to form a dipole square. The high band radiating elements consist of an array of three cross dipoles. A cross dipole is provided at the centre of each dipole square and one cross dipole is provided between the dipole squares.

U.S. Pat. No. 4,434,425 discloses an arrangement of concentric dipole squares suitable for receiving radiation concentrated by a parabolic reflector antenna. The outer ring consists of vertically and horizontally polarised dipole pairs whereas the inner dipole square consists of dipole pairs having slant 45 polarization. The arrangement provides a common phase centre for receiving radiation from a parabolic reflector.

U.S. Pat. No. 4,555,708 discloses a satellite navigation antenna for producing radiation having circular polarization.

It is desirable to provide a multi-band antenna that is compact, easy to manufacture and inexpensive, having good isolation, appropriate beam width, minimal grating lobes and a good cross polarization ratio.

U.S. Pat. No. 6,317,099 and U.S. Pat. No. 6,285,666 describe a folded dipole antenna with a ground plane; and a conductor having a microstrip feed section extending adjacent the ground plane and spaced therefrom by a dielectric, a radiator input section, and at least one radiating section integrally formed with the radiator input section and the feed section. The radiating section includes first and second ends, a fed dipole and a passive dipole, the fed dipole being connected to the radiator input section, the passive dipole being disposed in spaced relation to the fed dipole to form a gap, the passive dipole being shorted to the fed dipole at the first and second ends.

The radiating section is driven with a feed which is not completely balanced. An unbalanced feed can lead to unbalanced currents on the dipole arms which can cause beam skew in the plane of polarization (vertical pattern for a v-pole antenna, horizontal pattern for a h-pole antenna, vertical and horizontal patterns for a slant pole antenna), increased cross-polar isolation in the far field and increased coupling between polarizations for a dual polarized antenna.

A stripline folded dipole antenna is described in U.S. Pat. No. 5,917,456. A disadvantage of a stripline arrangement is that a pair of ground planes is required, resulting in additional expense and bulk.

U.S. Pat. No. 4,837,529 describes a microstrip to coaxial side-launch transition. A microstrip transmission line is provided on a first side of a ground plane, and a coaxial transmission line is provided on a second side of the ground plane opposite to the first side of the ground plane. The coaxial transmission line has a central conductor directly soldered to the microstrip line. Direct soldering to the microstrip line has a number of disadvantages. Firstly, the integrity of the joint cannot be guaranteed. Secondly, it is necessary to construct the microstrip line from a metal which allows the solder to flow. The coaxial cylindrical conductor sleeve is also directly soldered to the ground plane. Direct soldering to the ground plane has the disadvantages given above, and also the further disadvantage that the ground plane will act as a large heat sink, requiring a large amount of heat to be applied during soldering.

SUMMARY OF THE INVENTION

According to one exemplary embodiment there is provided a folded dipole having a dipole axis and a pair of arms which together have a profile which is concave on one side and convex on the other when viewed along the dipole axis.

The term "dipole axis" is used herein to refer to an axis of propagation of the dipole. An example of a dipole axis 112 is illustrated in FIG.1 and is typically perpendicular to a reflective ground plane which is mounted in use, adjacent to the dipole. The dipole typically also has an input section (such as a pair of feed legs), and in this case the dipole axis 112 is typically parallel with the input section.

The concavo-convex geometry of the arms of the folded dipole provide a particularly compact arrangement, enabling the arms to "wrap around" an adjacent region. The sides of the arms may be straight (for instance v-shaped) or curved.

According to a further exemplary embodiment there is provided a dipole box comprising two or more folded dipoles arranged around a central region, each folded dipole having a dipole axis and a pair of arms which together have a profile which is concave on one side and convex on the other when viewed in plan perpendicular to the central region.

It should be noted that the term "box" is used herein as a generic term including (but not limited to) circular and square arrangements.

A further exemplary embodiment provides a dipole box comprising two or more dipoles arranged end to end around a central region, wherein the ends of adjacent dipoles are retained together by electrically insulating retaining elements.

The retaining elements increase the rigidity of the dipole box, and enable the spacing between the adjacent dipoles to be controlled accurately.

In a first embodiment, the element comprising a frame formed by an opposed pair of side walls and an opposed pair of end walls; a dividing wall joining the opposed pair of side walls; and a pair of projections each provided on a respective end wall and directed inwardly towards the dividing wall. In a second embodiment the element comprising a body portion having a pair of sockets on opposite side of the body portion; and a pair of resilient members which each obstruct a respective socket and resiliently flex, when in use, to admit an end of a dipole into the socket.

A further exemplary embodiment provides an antenna comprising:

a first module comprising an outer box of two or more dipoles arranged around a first central region, and an inner box of two or more dipoles located in the first central region concentrically with the outer box; and a second module comprising an outer box of two or more dipoles arranged around a second central region which is spaced from the first region, and an inner box of two or more dipoles located in the second central region concentrically with the outer box.

A further exemplary embodiment provides a method of manufacturing a folded dipole having a dipole axis and a pair of arms which together have a profile which is concave on one side and convex on the other when viewed along the dipole axis, the method comprising forming the pair of arms from a sheet of conductive material.

A further exemplary embodiment provides a dual polarized folded dipole antenna comprising:

a first unit configured for transmitting and/or receiving signals in a first polarization direction; and a second unit configured for transmitting and/or receiving signals in a second polarization direction different to the first polarization direction, wherein each unit includes a conductor having a feed section, a radiator input section, and at least one radiating section integrally formed with the radiator input section and the feed section, the radiating section including first and second ends, a fed dipole and a passive dipole, the fed dipole being connected to the radiator input section, the passive dipole being disposed in spaced relation to the fed dipole to form a gap, the passive dipole being shorted to the fed dipole at the first and second ends.

A further exemplary embodiment provides a folded dipole antenna comprising:

a ground plane a conductor having a feed section extending adjacent the ground plane and spaced therefrom by a dielectric, a radiator input section, and at least one radiating section integrally formed with the radiator input section and the feed section, the radiating section including first and second ends, a fed dipole and a passive dipole, the fed dipole being connected to the radiator input section, the passive dipole being disposed in spaced relation to the fed dipole to form a gap, the passive dipole being shorted to the fed dipole at the first and second ends, wherein the feed section is a microstrip feed section having an adjacent ground plane on one side only, and wherein the radiator input section includes a balun transformer.

The balun transformer provides a balanced feed and obviates the problems discussed above.

A further exemplary embodiment provides a folded dipole antenna comprising:

a ground plane a conductor having a feed section extending adjacent the ground plane and spaced therefrom by a dielectric, a radiator input section, and at least one radiating section integrally formed with the radiator input section and the feed section, the radiating section including first and second ends, a fed dipole and a passive dipole, the fed dipole being connected to the radiator input section, the passive dipole being disposed in spaced relation to the fed dipole to form a gap, the passive dipole being shorted to the fed dipole at the first and second ends, wherein the feed section is a microstrip feed section having an adjacent ground plane on one side only, and wherein the radiator input section includes a splitter, first and second feedlines which meet said feed section at said splitter so as to complete a closed loop including the first and second feedlines and the radiating section, and a phase delay element for introducing a phase difference between the first and second feedlines.

A further exemplary embodiment provides a coaxial to microstrip transition comprising:

a ground plane;

a microstrip transmission line on a first side of the ground plane;

a coaxial transmission line on a second side of the ground plane opposite to the first side of the ground plane, the coaxial transmission line having a central conductor coupled to the microstrip line, a coaxial cylindrical conductor sleeve coupled to the ground plane, and a dielectric material between the central conductor and the sleeve, a conductive ground transition body in conductive engagement with the sleeve; and a ground locking member applying a force to the ground transition body so as to force the ground transition body into conductive engagement with the ground plane.

This construction obviates the need for a direct solder joint between the sleeve and the ground plane.

A further exemplary embodiment provides a coaxial to microstrip transition comprising:

a ground plane;

a microstrip transmission line on a first side of the ground plane;

a coaxial transmission line on a second side of the ground plane opposite to the first side of the ground plane, the coaxial transmission line having a central conductor coupled to the microstrip line, a coaxial cylindrical conductor sleeve coupled to the ground plane, and a dielectric material between the central conductor and the sleeve, a conductive line transition body in conductive engagement with the central conductor; and a line locking member applying a force to the line transition body so as to force the line transition body into conductive engagement with the microstrip line.

This construction obviates the need for a direct solder joint between the central conductor and the microstrip line.

A further exemplary embodiment provides a method of constructing a coaxial to microstrip transition, the method comprising:

arranging a microstrip transmission line on a first side of a ground plane;

arranging a coaxial transmission line on a second side of the ground plane opposite to the first side of the ground plane, the coaxial transmission line having a central conductor coupled to the microstrip line, a coaxial cylindrical conductor sleeve coupled to the ground plane, and a dielectric material between the central conductor and the sleeve, arranging a conductive ground transition body in conductive engagement with the sleeve; and applying a force to the ground transition body so as to force the ground transition body into conductive engagement with the ground plane.

A further exemplary embodiment provides a method of constructing a coaxial to microstrip transition, the method comprising:

arranging a microstrip transmission line on a first side of a ground plane;

arranging a coaxial transmission line on a second side of the ground plane opposite to the first side of the ground plane, the coaxial transmission line having a central conductor coupled to the microstrip line, a coaxial cylindrical conductor sleeve coupled to the ground plane, and a dielectric material between the central conductor and the sleeve, arranging a conductive line transition body in conductive engagement with the central conductor; and applying a force to the line transition body so as to force the line transition body into conductive engagement with the microstrip line.

BRIEF DESCRIPTION OF THE DRAWINGS

The accompanying drawings which are incorporated in and constitute part of the specification, illustrate embodiments of the invention and, together with the general description of the invention given above, and the detailed description of the embodiments given below, serve to explain the principles of the invention.

FIG. 7C is an isometric view of two adjacent radiating sections;

FIG. 7D is an isometric view of the radiating sections with a clip inserted;

DETAILED DESCRIPTION OF THE INVENTION

Figure 1:
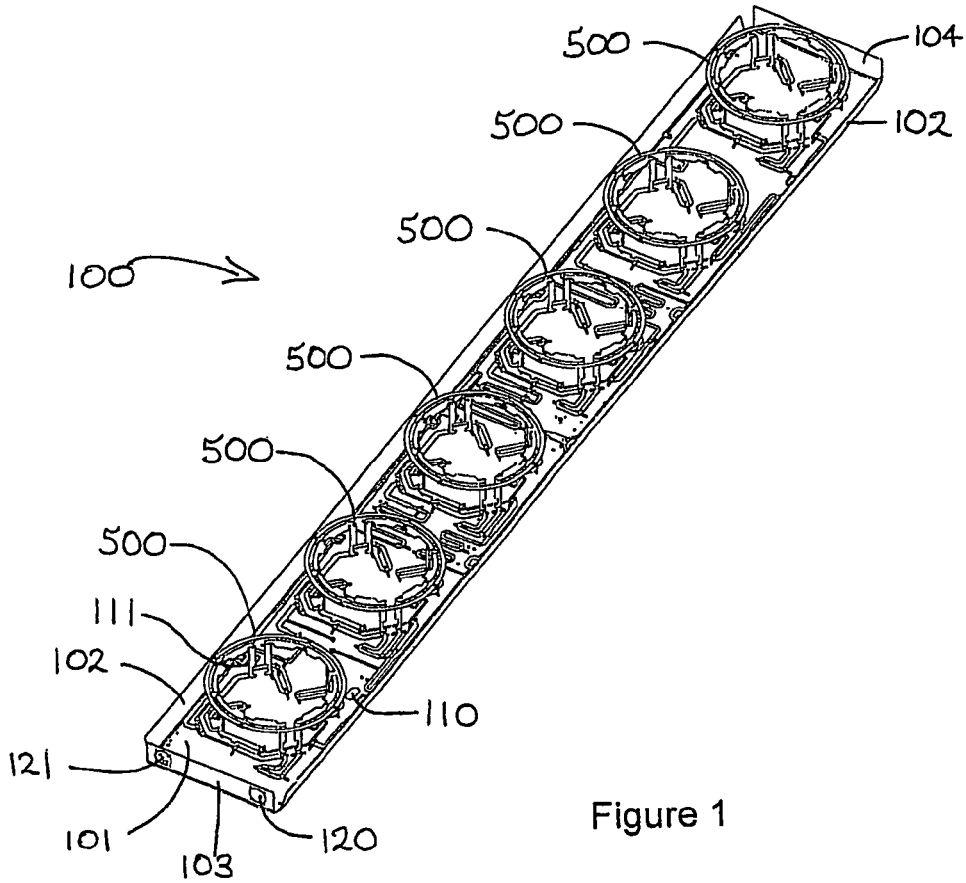
FIG. 1 is an isometric view of a dual polarization folded dipole antenna according to one embodiment of the present invention.
Figure 2:
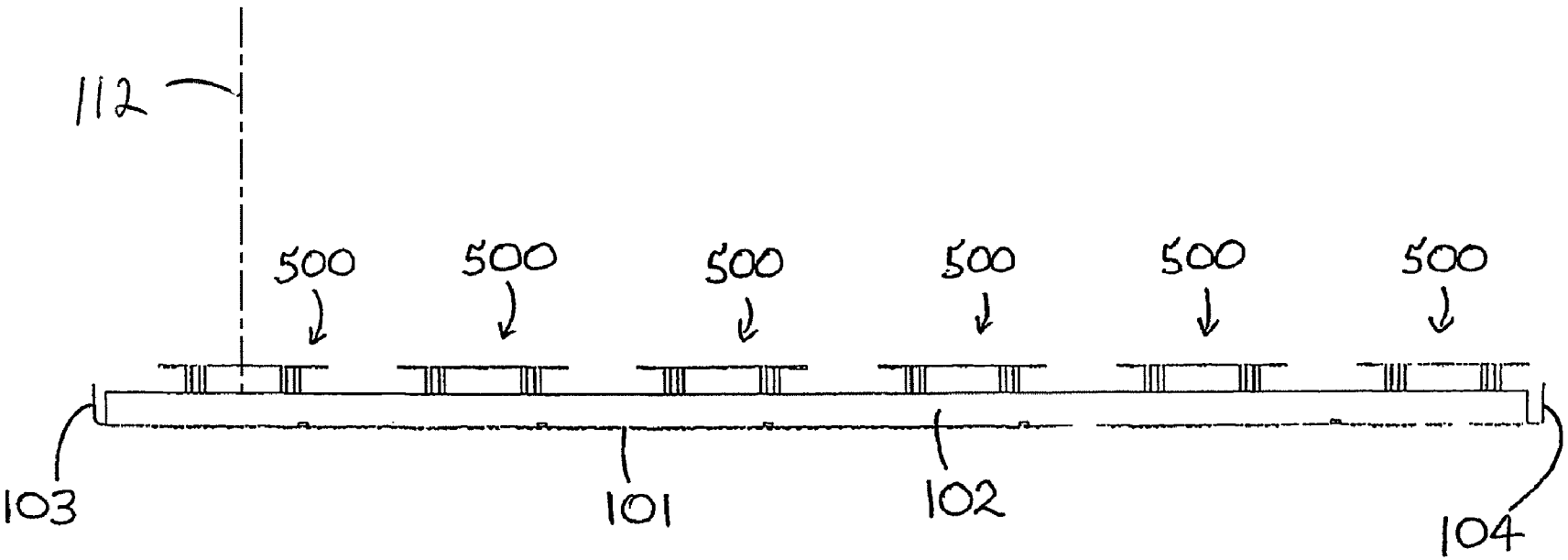
FIG. 2 is a side view of the dual polarization folded dipole antenna of FIG. 1.

FIGS. 1 and 2 show a slant polarized dual polarization folded dipole antenna 100 according to the invention. A reflector tray is formed by a ground plane 101, lower and upper end walls 103,104 and side walls 102. A +45° integrally formed microstrip antenna unit 300 (shown in FIG. 3) and a −45° integrally formed microstrip antenna unit 400 (shown in FIG. 4) are mounted adjacent, and substantially parallel to, the ground plane 101, as described in detail below. Together, the radiating sections of the microstrip antenna units 300,400 form a number of generally circular radiating modules 500 which are spaced apart along an antenna axis. The antenna is generally mounted is use on a base station mast with the antenna axis oriented in a vertical direction. The +45° antenna unit 300 radiates with a polarization at +45° to the antenna axis, while the −45° antenna unit 400 radiates with a polarization at −45° to the antenna axis.

Figure 3:
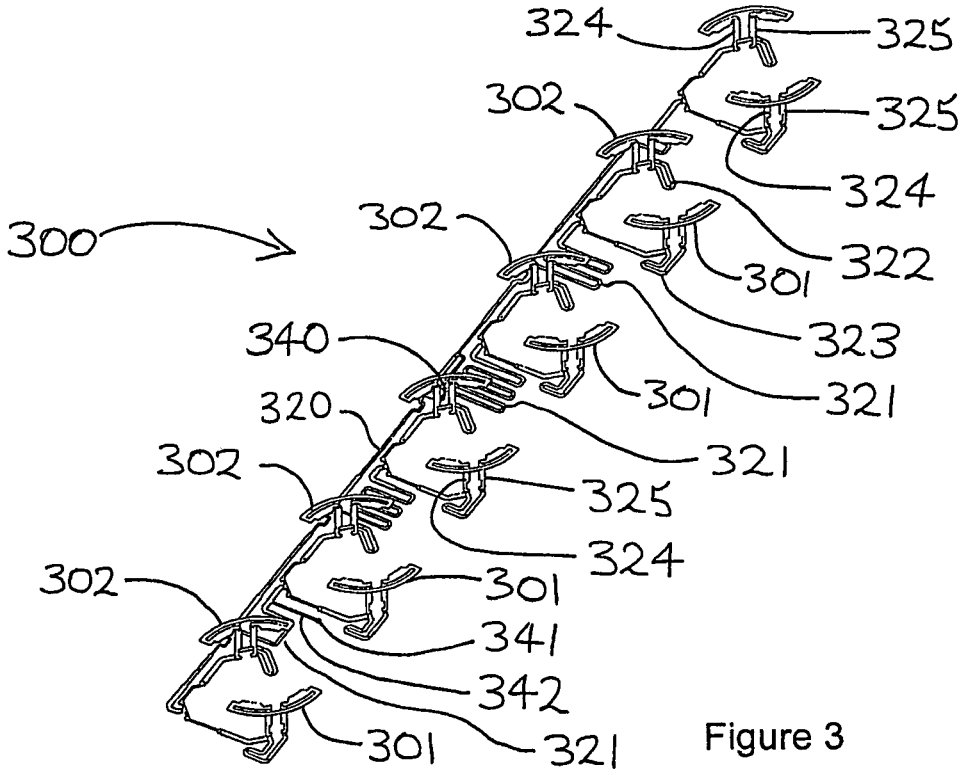
FIG. 3 is an isometric view of the +45° antenna unit.
Figure 3A:
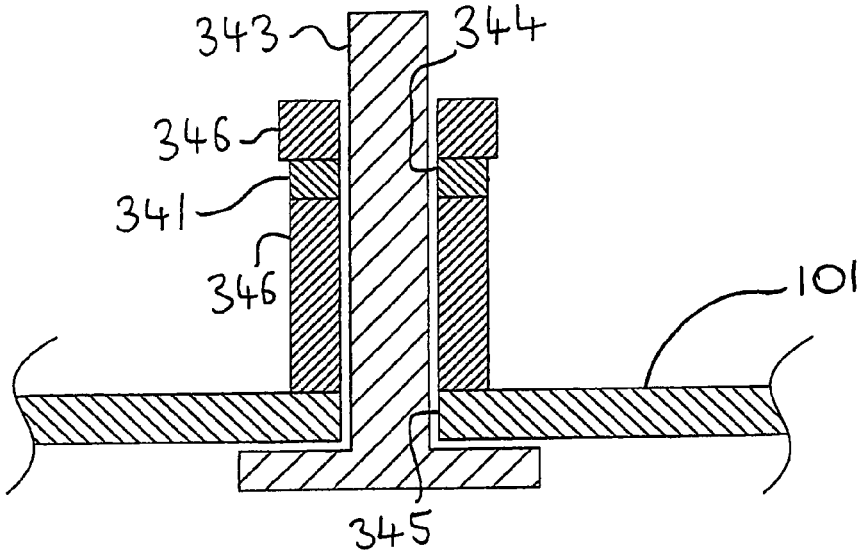
FIG. 3A is a cross-sectional view through a DC ground connection.

FIG. 3 shows the +45° microstrip antenna unit 300. The antenna unit comprises a feed section 320, radiator input sections (including dipole feed legs 324 and 325, and phase delay lines 322, 323) and radiating sections 301 and 302. The feed section, radiator input sections and radiating sections are formed integrally, by cutting or stamping from a flat sheet of conductive material such as, for example, a metal sheet comprised of aluminum, copper, brass or alloys thereof. Since the antenna unit is formed integrally, the number of mechanical contacts necessary is reduced, improving the intermodulation distortion (IMD) performance of the antenna 100. The feed section 320 branches out from a single RF input section 340 (partially obscured) that is electrically connected to a coaxial transmission line (not shown in FIGS. 1-4) via a transition shown in detail in FIGS. 9-13 and described in further detail below. The coaxial transmission line passes along the rear side of the ground plane 101, through one of the slots 110 or 111 in the ground plane (shown in FIG. 1) and through one of the holes 120 or 121 in the lower end wall 103. Many other paths for the transmission line may also be suitable. The transmission line is generally electrically connected to an RF device such as a transmitter or a receiver. In one embodiment, the RF input section 340 directly connects to the RF device. The feed section 320 also includes a DC ground connection, positioned at the end of a quarter wavelength stub 342. The DC ground connection is shown in cross-section in FIG. 3A. The stub 342 has a circular pad 341 at its end with a hole 344. A bolt 343 passes through the hole 344 and a hole 345 in the ground plane 101. A cylindrical metal spacer 346 has an external diameter greater than the internal diameters of the holes 344,345 and engages the pad 341 at one end and the ground plane 101 at the other end. The bolt 343 is threaded at its distal end and an internally threaded nut 346 compresses the pad 341 and the groundplane 101 together with a given torque to ensure a tight metal joint for good intermodulation performance.

The feed section 320 further includes a number of meandering phase delay lines 321, to provide a desired phase relationship between the radiating sections 301,302 and between the modules 500. In the embodiment shown in FIG. 3, the meandering phase delay lines 321 are configured so that the all radiating sections 301, 302 and all modules 500 are at the same phase. Alternatively the lines 321 may be configured to give a fixed phase difference (and hence downtilt) between the modules.

Figure 4:
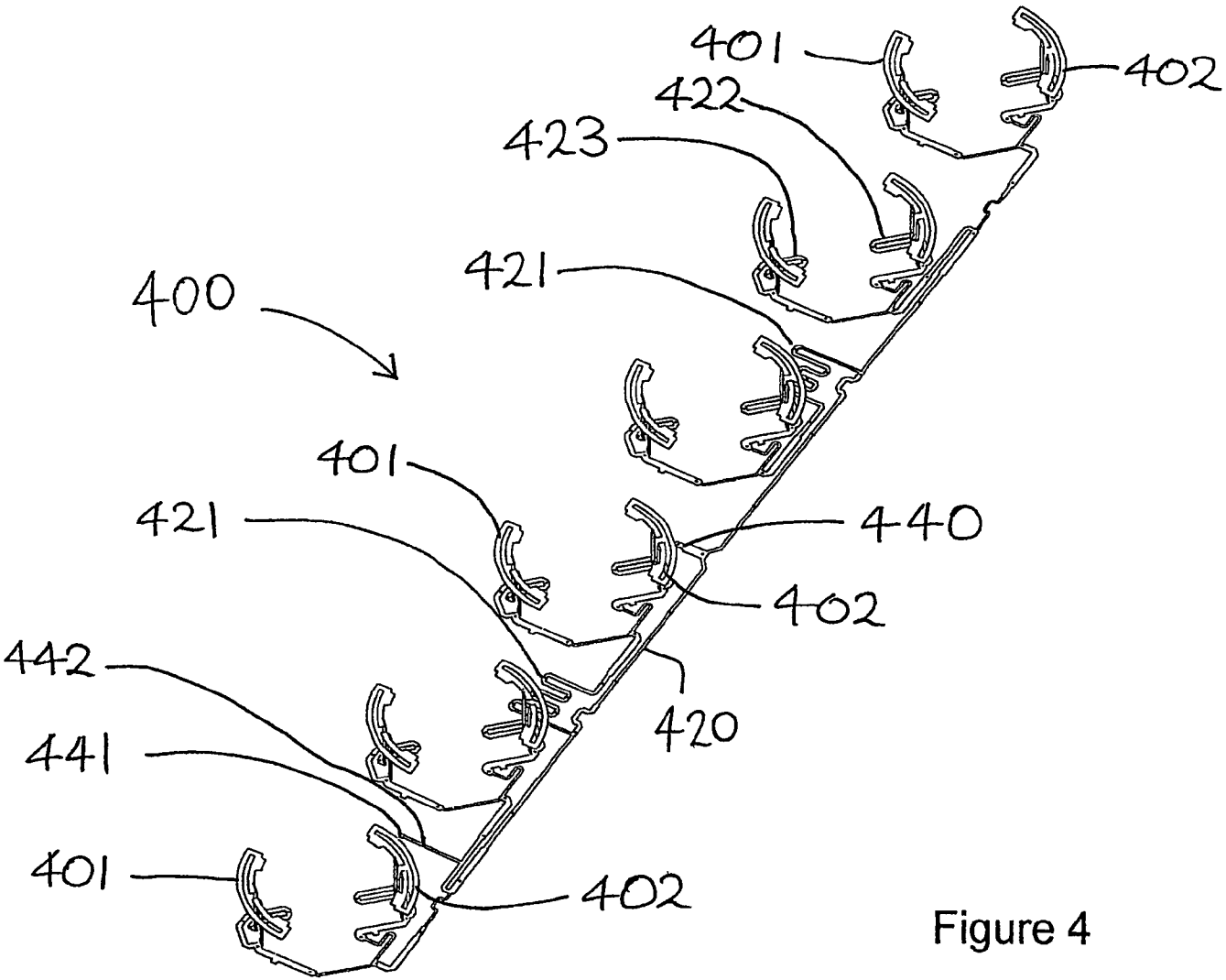
FIG. 4 is an isometric view of the −45° antenna unit.

FIG. 4 shows the −45° microstrip antenna unit 400. The unit is similar to the +45° antenna unit, and similar elements are given the same reference numerals, increased by 100. For instance the equivalent to the +45° radiating sections 301, 302 are −45° radiating sections 401,402. It will be seen by a comparison of FIGS. 3 and 4 that the +45° unit 300 and −45° unit 400 interlock together to form the dual-polarized modules 500.

Figure 5:
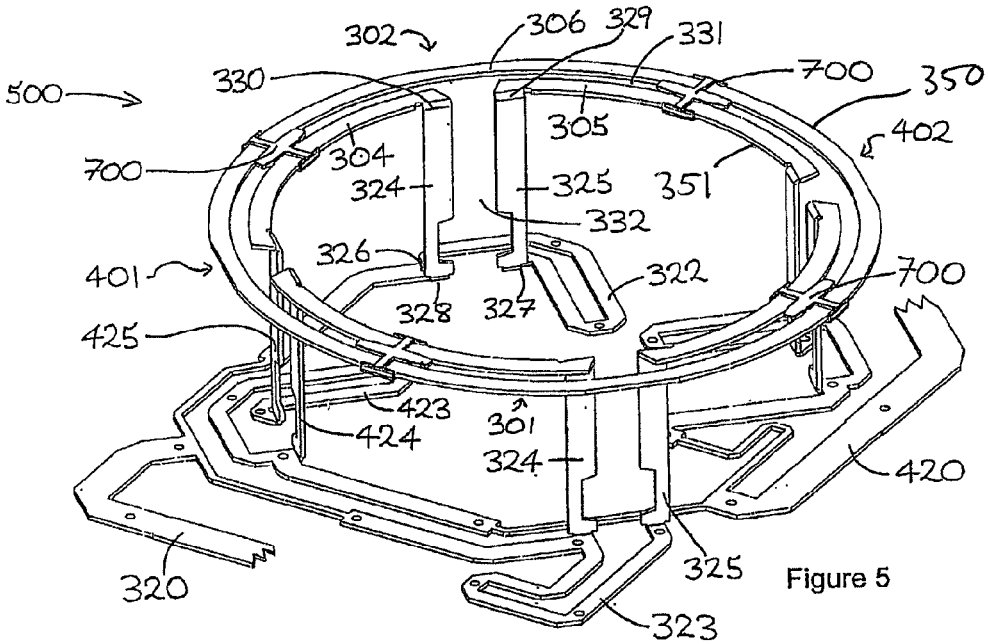
FIG. 5 is an isometric view of a single radiating module of the antenna of FIG. 1.
Figure 14:
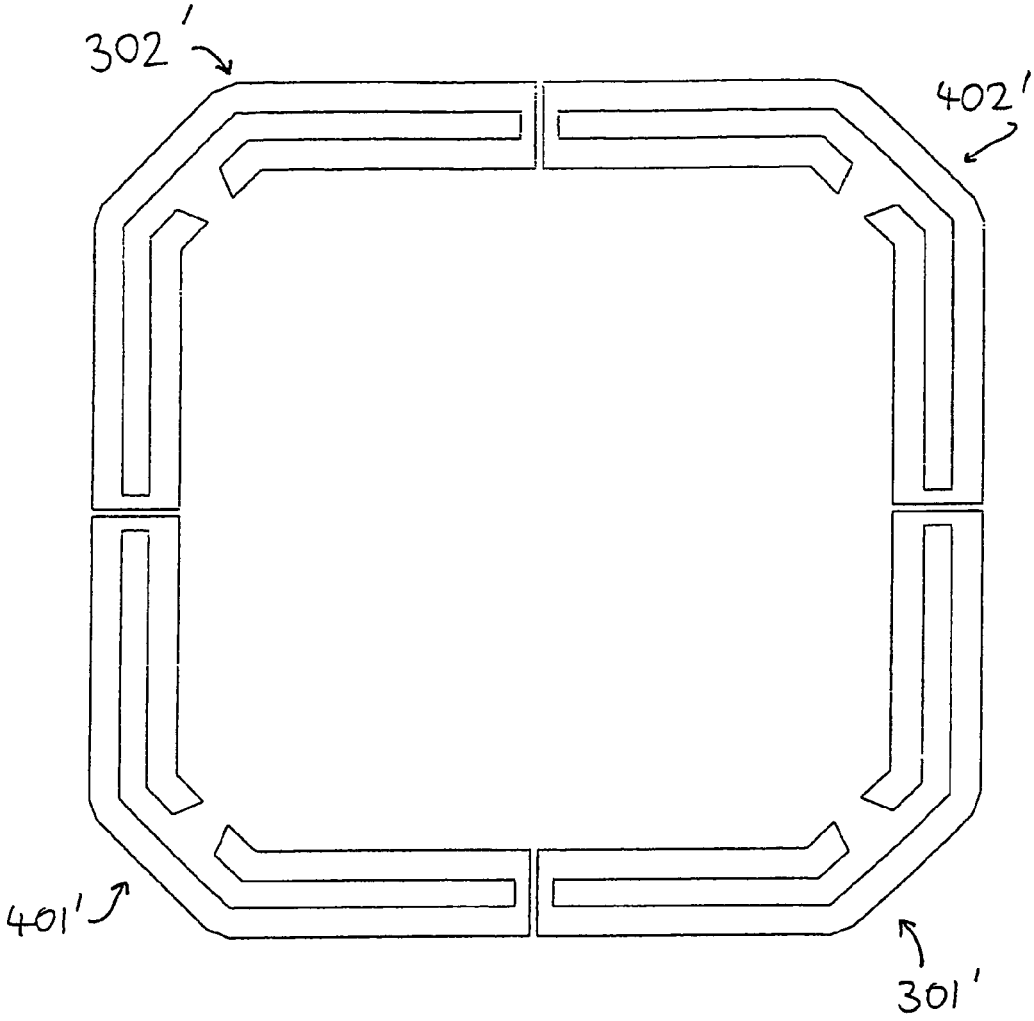
FIG. 14 is a plan view of an alternative radiating section configuration.

FIG. 5 shows an exemplary one of the radiating modules 500. The radiating module comprises radiating sections 301, 302, 401 and 402 arranged in a circular "box" configuration around a central region. An alternative square "box" configuration is shown in FIG. 14. The radiating sections are similar in construction and only radiating section 302 will be described in full. Radiating section 302 includes a fed dipole (comprising a first quarter-wavelength monopole 304 and a second quarter-wavelength monopole 305) and a passive dipole 306, separated by a gap 331. End sections of the conductor (concealed in FIG. 5 beneath a clip 700) at opposing ends of the gap 331 electrically short the monopoles 304,305 with the passive dipole 306.

The fed and passive dipoles are each generally curvilinear in shape and lie in a plane parallel to the plane of the ground plane 101 (i.e., a plane orthogonal to the axis of propagation of the dipoles). The centre of curvature of the fed and passive dipoles lie at the centre of the module. In this embodiment each folded dipole extends over about a quarter circle so that a ring of folded dipoles forms an approximately circular dipole ring. It can be seen that the folded dipoles are generally concavo-convex as viewed along their axes of propagation perpendicular to the ground plane. That is, they have a convex outer side 350 and a concave inner side 351.

The first quarter-wavelength monopole 304 is connected to the first dipole feed leg 324 at bend 330. The first dipole feed leg 324 is connected to the feed section 320 at a splitter junction 326. The second quarter-wavelength monopole 305 is connected to the second dipole feed leg 325 at bend 329. The second dipole feed leg 325 is connected to a 180° phase delay line 322 at bend 327. The phase delay line 322 is connected at its other end to the splitter junction 326. The length of the phase delay line 322 is selected such that the dipole feed legs 324 and 325 have a phase difference of 180°, thus providing a balanced feed to the fed dipole. It will be appreciated that the feed legs 324,325, radiating section 304, 305,306 and phase delay line 322 together define a closed loop. The phased line 322 and splitter junction 326 together act as a balun (a balanced to unbalanced transformer).

In a first alternative arrangement (not shown), the shorter feed path (that is, the feed path between the splitter junction 326 and the feed leg 324) may include two quarter-wave separated open half-wavelength stubs, as described in U.S. Pat. No. 6,515,628. The stubs compensate or balance the phase across the frequency band of interest.

In a second alternative arrangement (not shown), the balun formed by the splitter junction 326 and phase delay line 322 may be replaced by a Schiffman coupler as described in U.S. Pat. No. 5,917,456.

Together the dipole feed legs have an intrinsic impedance that is adjusted to match the radiating section 302 to the feed section. This impedance is adjusted, in part, by varying the width of the dipole feed legs 324, 325 and the gap 332. The bends are such that the dipole feed legs 324 and 325 are substantially perpendicular to the feed section 320 and the ground plane 101, and the radiating section 302 is substantially parallel to the feed section 320 and the ground plane 101. The radiating sections 301, 302, 401 and 402 are mechanically connected by a dielectric clip 700, which is further described below. This connection provides greater stability and strength, and ensures correct spacing of the radiating sections.

Figure 6A:
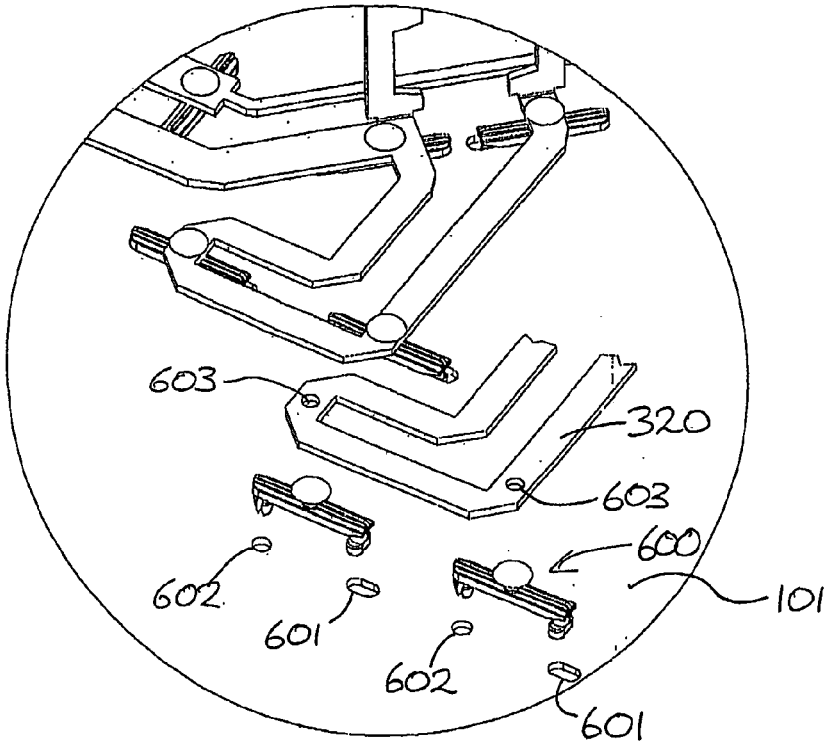
FIG. 6A is an isometric view showing the method of fixing the antenna units to the ground plane, in the antenna of FIG. 1.
Figure 6B:
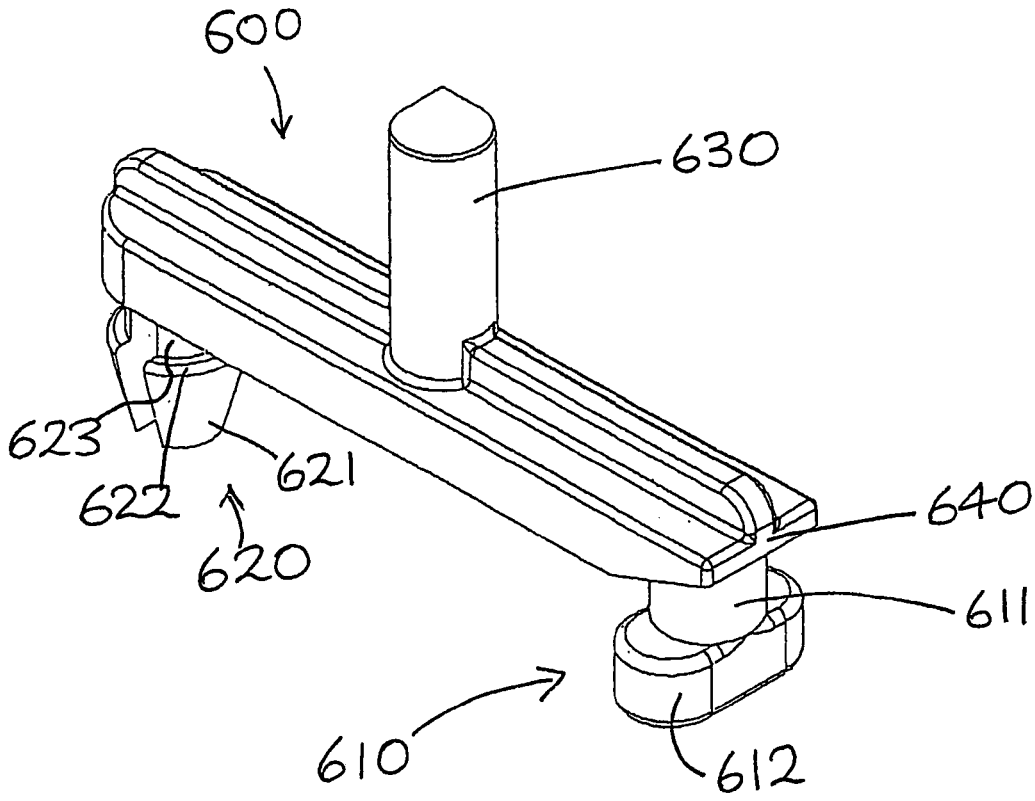
FIG. 6B is an isometric view of the dielectric spacer shown in FIG. 6A.

The microstrip antenna units 300 and 400 could be spaced from the ground plane 101 by any dielectric, such as air, foam, etc. In the preferred embodiment, the microstrip antenna units are spaced from the ground plane by air, and are fixed to the ground plane using dielectric spacers 600 shown in FIG. 6A and in detail in FIG. 6B, although other types of dielectric support could also be used. Other possible dielectric supports include nuts and bolts with dielectric washers, screws with dielectric washers, etc.

Figure 6C:
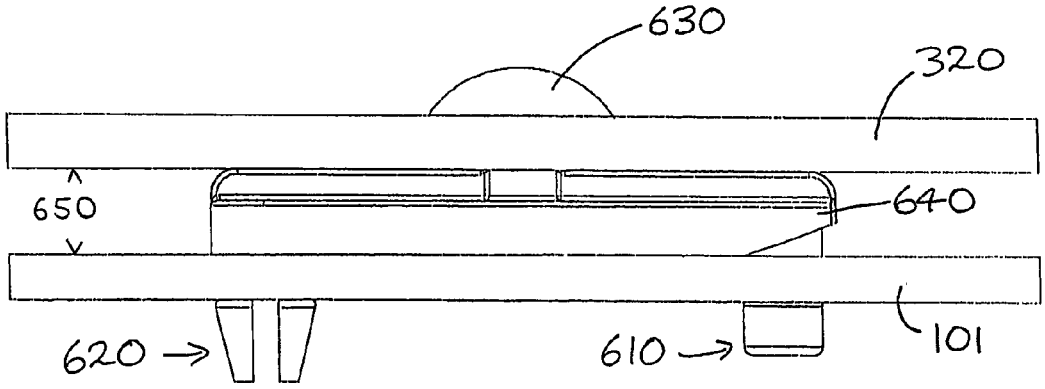
FIG. 6C is a side view of the assembled ground plane, dielectric spacer and antenna unit.

The dielectric spacers 600 have a body portion 640, stub 630, and lugs 610 and 620 which fit into a slot 601 and a hole 602 respectively in the ground plane. The lug 610 comprises a neck 611 and a lower transverse elongate section 612. The lug 620 comprises two legs having a lower sloping section 621, a shoulder 622 and neck 623. The legs are resilient so that they bend inwardly when forced through the hole 602 in the ground plane, and spring back when the shoulder 622 has passed through. To fix the dielectric spacer 600 to the ground plane 101 the elongate section 612 is passed through the slot 601; the dielectric spacer is rotated through 90 degrees, such that the elongate section cannot pass back through the slot 601; and the lug 620 is forced through the hole 602. The shoulders 622 and elongate section 612 are spaced from the body portion 640 by a distance corresponding to the thickness of the ground plane so that the dielectric spacer and ground plane are fixed together when the shoulders and elongate section 612 engage the back side of the ground plane. The stub 630 is received in a hole 603 in the feed section 320 or 420. The top of the stub 630 is then deformed by heating such that the feed section 320 or 420, body portion 640 and ground plane 101 are fixed together, as shown in the cross-section of FIG. 6C. FIG. 6C also shows the air gap 650 between the air suspended microstrip feed section 320 and the ground plane 101. The spacer 600 is precisely machined so as to maintain a desired gap.

Figure 7A:
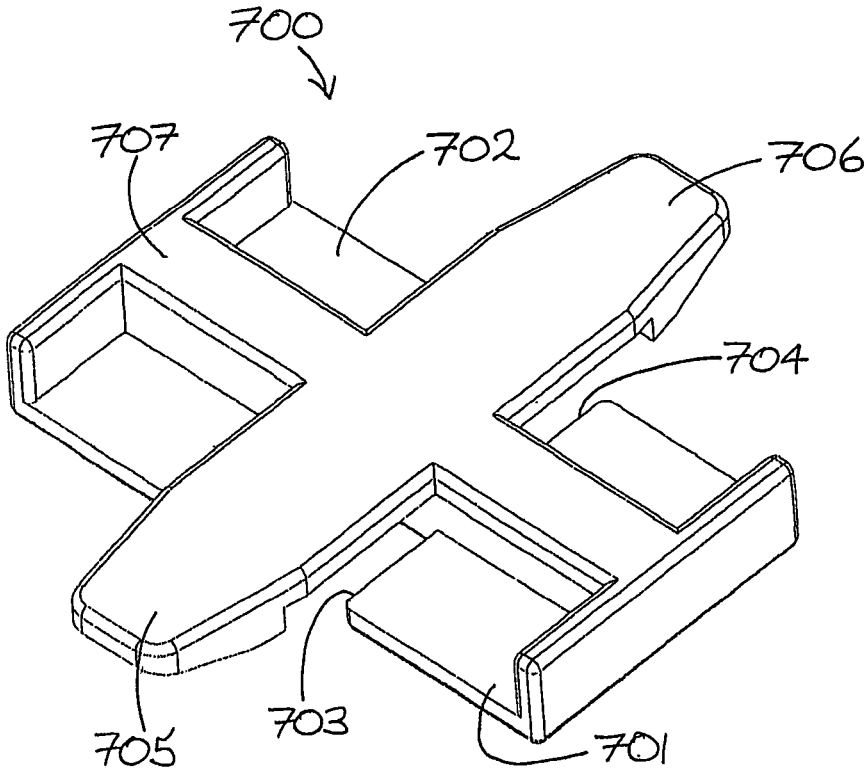
FIG. 7A is an isometric top view of the dielectric clip.
Figure 7B:
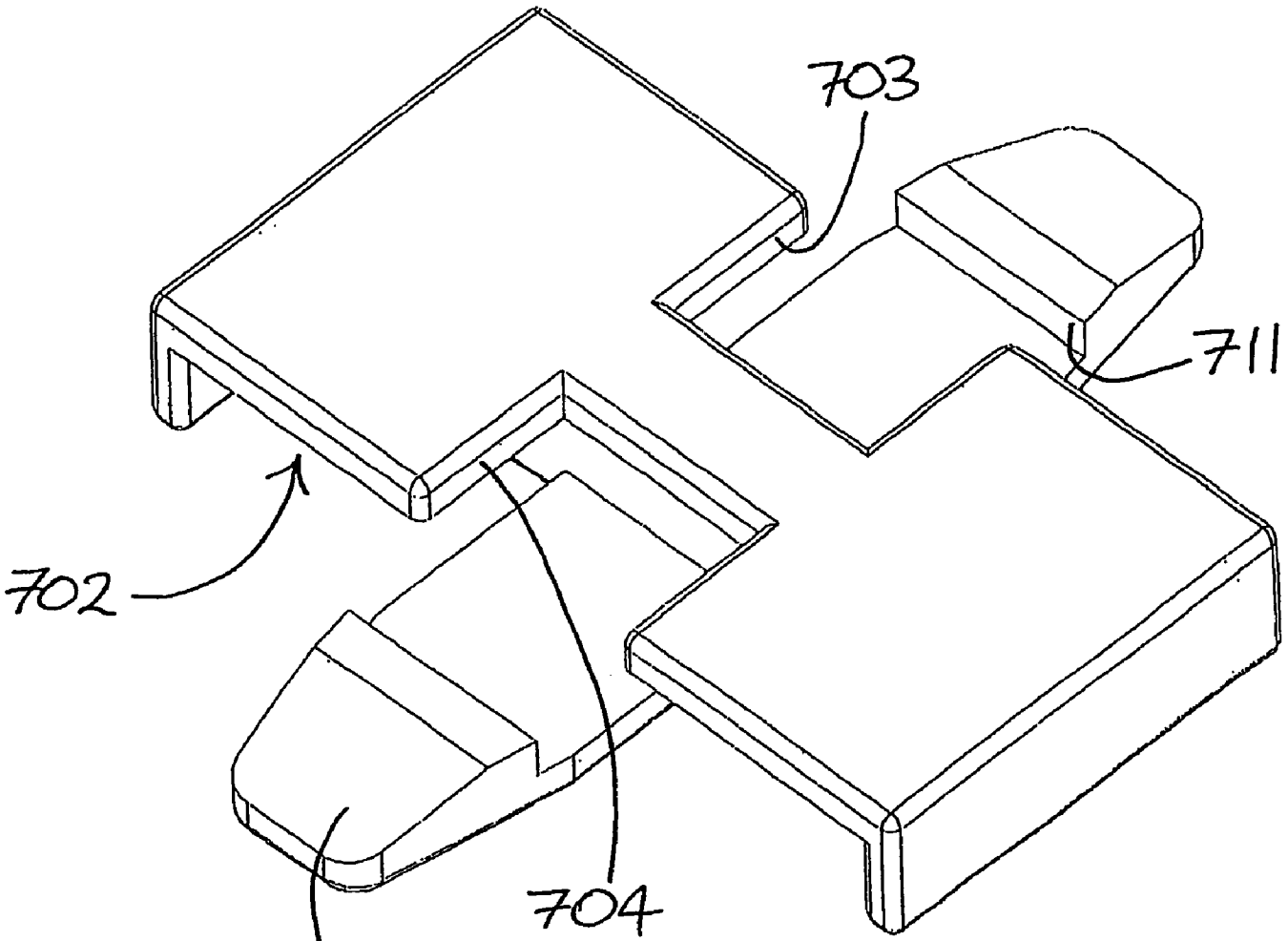
FIG. 7B is an isometric bottom view of the dielectric clip.

The dielectric clip 700 is shown in more detail in FIGS. 7A and 7B. The clip comprises a body portion formed with a longitudinal rib 707, and a pair of sockets 701,702 which receive the ends of the radiating sections 301,402. Slots 703, 704 are provided in the base of the sockets 701,702. A pair of spring arms 705,706 extend transversely from the rib 707. The spring arms 705,706 are identical and are each formed with a catch at their distal end including an angled ramp 710 and locking face 711.

The clip is formed using a two-part mold, and the purpose of slots 703,704 is to enable the under-surface of spring arms 705,706 to be properly molded.

FIG. 7C shows the ends of radiating sections 301,402 before the clip 700 is attached. The fed monopoles 304,305 are shorted to the passive dipole 306 by end sections 307. The end section 307 has an inner edge 309 and inner face 308. The clip 700 is mounted by pulling the radiating section 402 away to give sufficient clearance, and sliding the clip into place with the end section 307 received in the socket 701 as shown in FIG. 7D. As the clip slides into place, the ramp 710 (which partially obstructs the socket) engages the end section 307, causing the spring arm 705 to resiliently flex upwardly until the locking face 711 clears the inner edge 309 and snaps into engagement with the inner face 308 of the end section 307.

The other radiating section 402 is then snapped into the opposite socket 702 in a similar manner. With the clip in place as shown in FIG. 7C, the longitudinal rib 707 maintains a precise spacing between the radiating sections 301,402.

Figure 8:
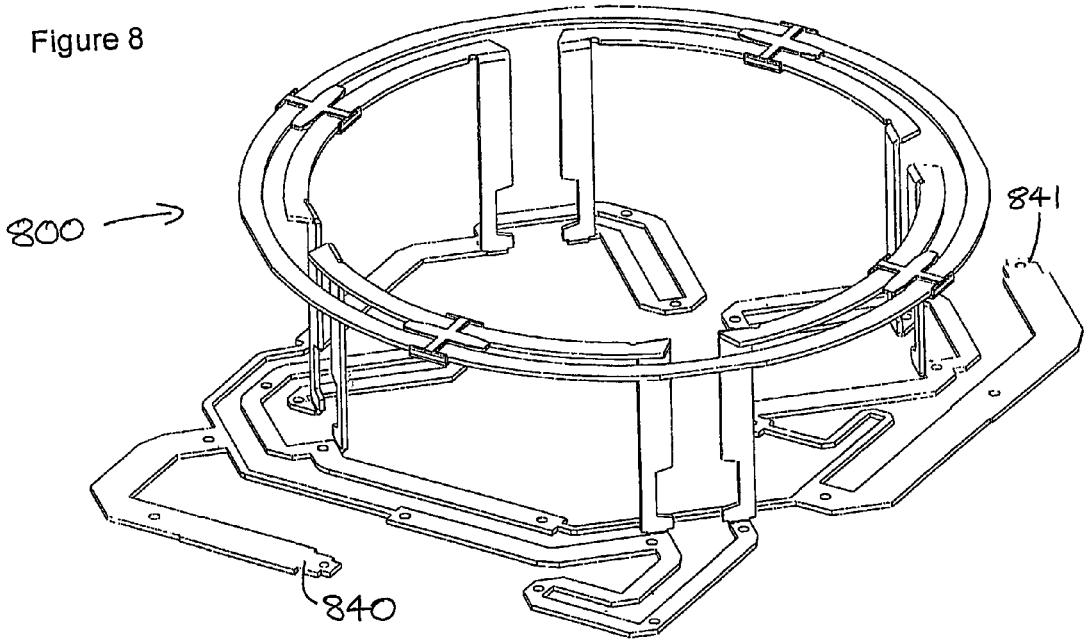
FIG. 8 is an isometric view of a dual polarization folded dipole antenna having a single radiating module, according to a second embodiment of the present invention.
Figure 9:
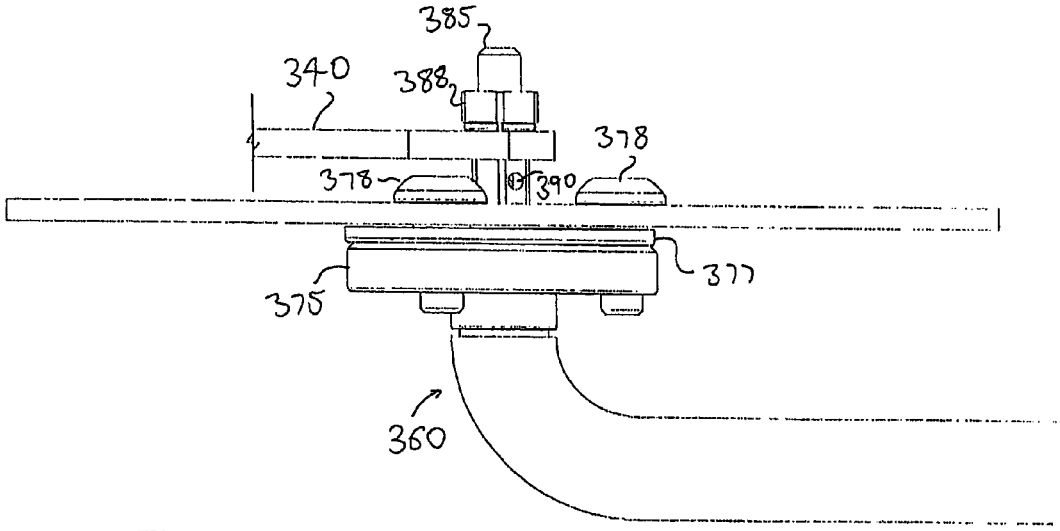
FIG. 9 is a side view of the coaxial to microstrip transition.
Figure 10:
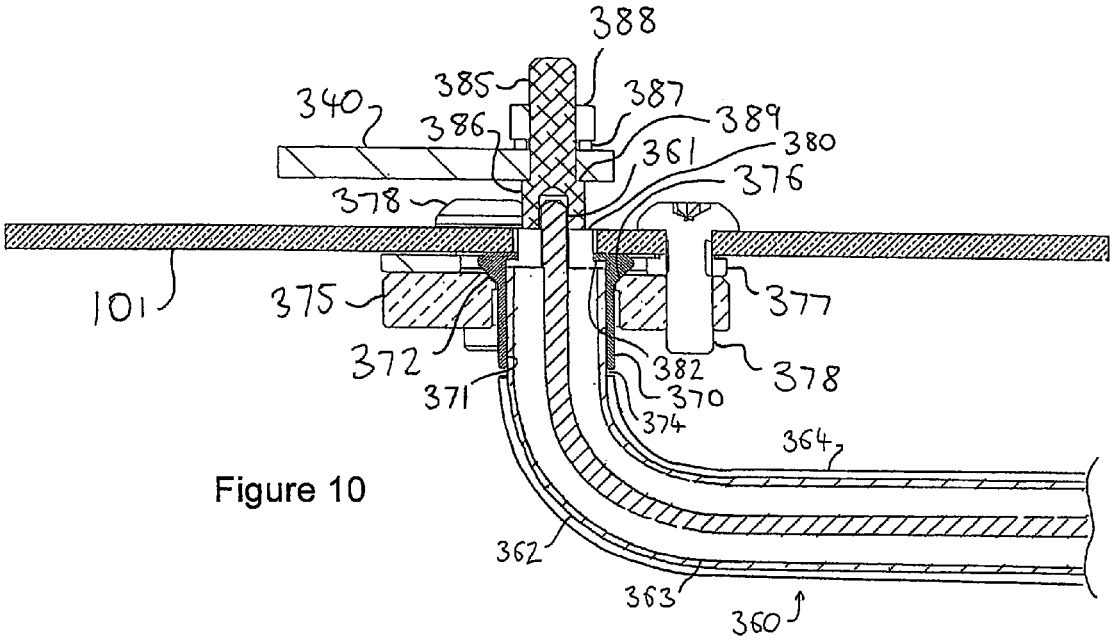
FIG. 10 is a cross-sectional view of the coaxial to microstrip transition of FIG. 9.
Figure 11:
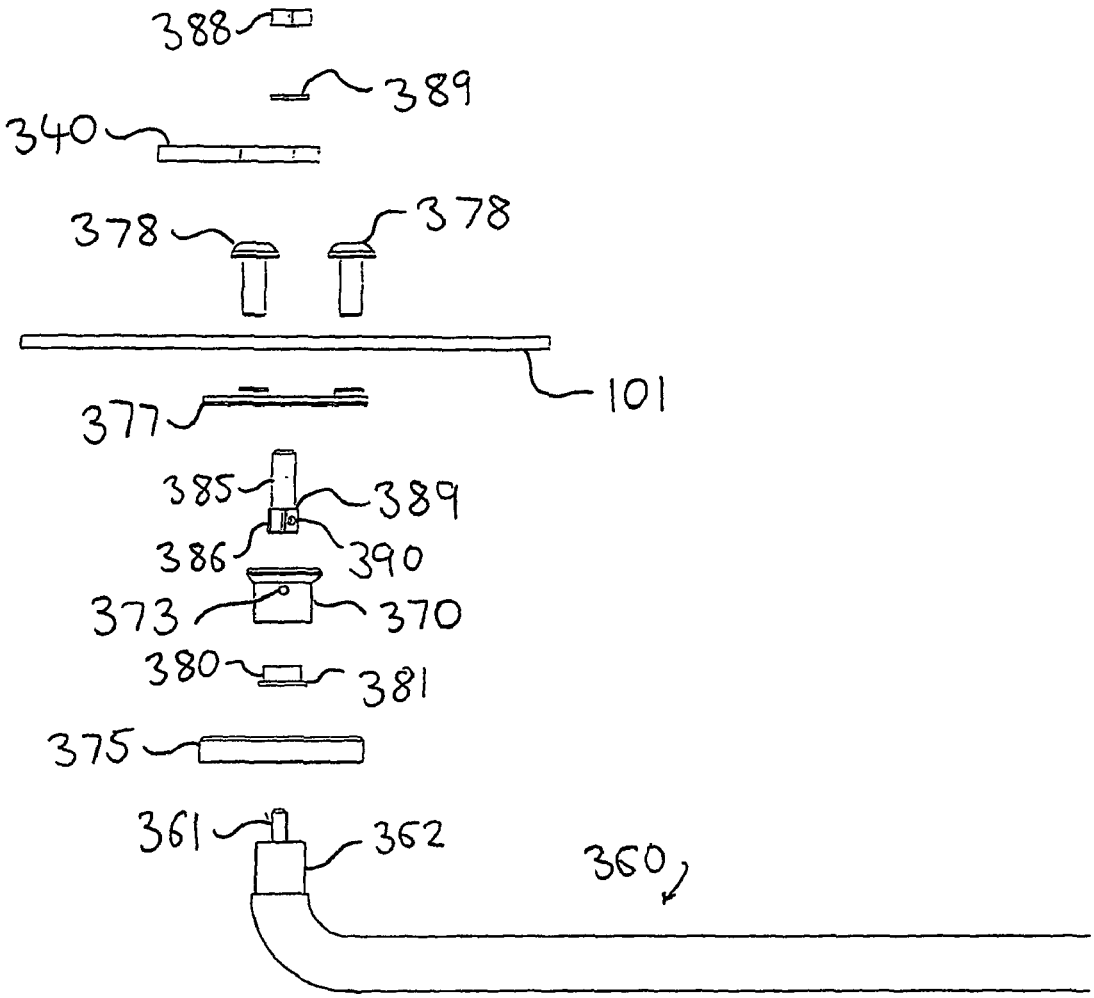
FIG. 11 is an exploded view of the coaxial .to microstrip transition of FIG. 9.
Figure 12:
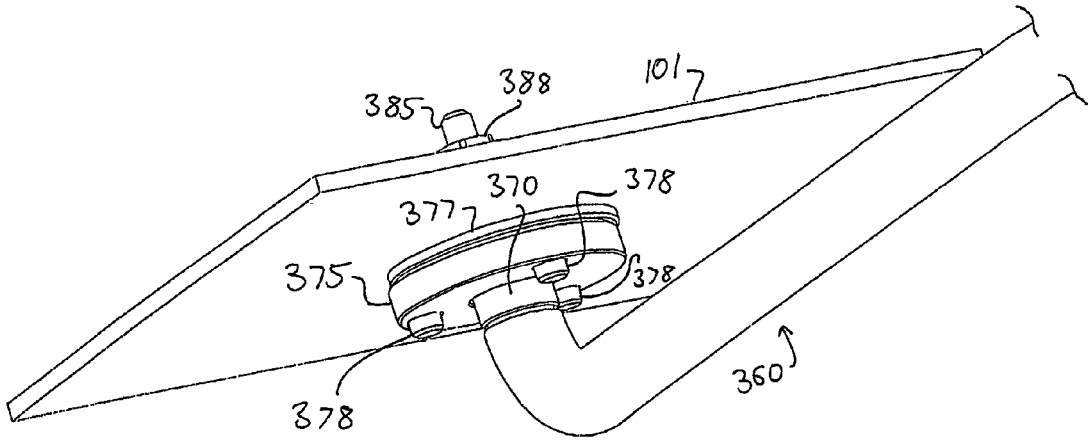
FIG. 12 is a first perspective view of the coaxial to microstrip transition of FIG. 9.
Figure 13:
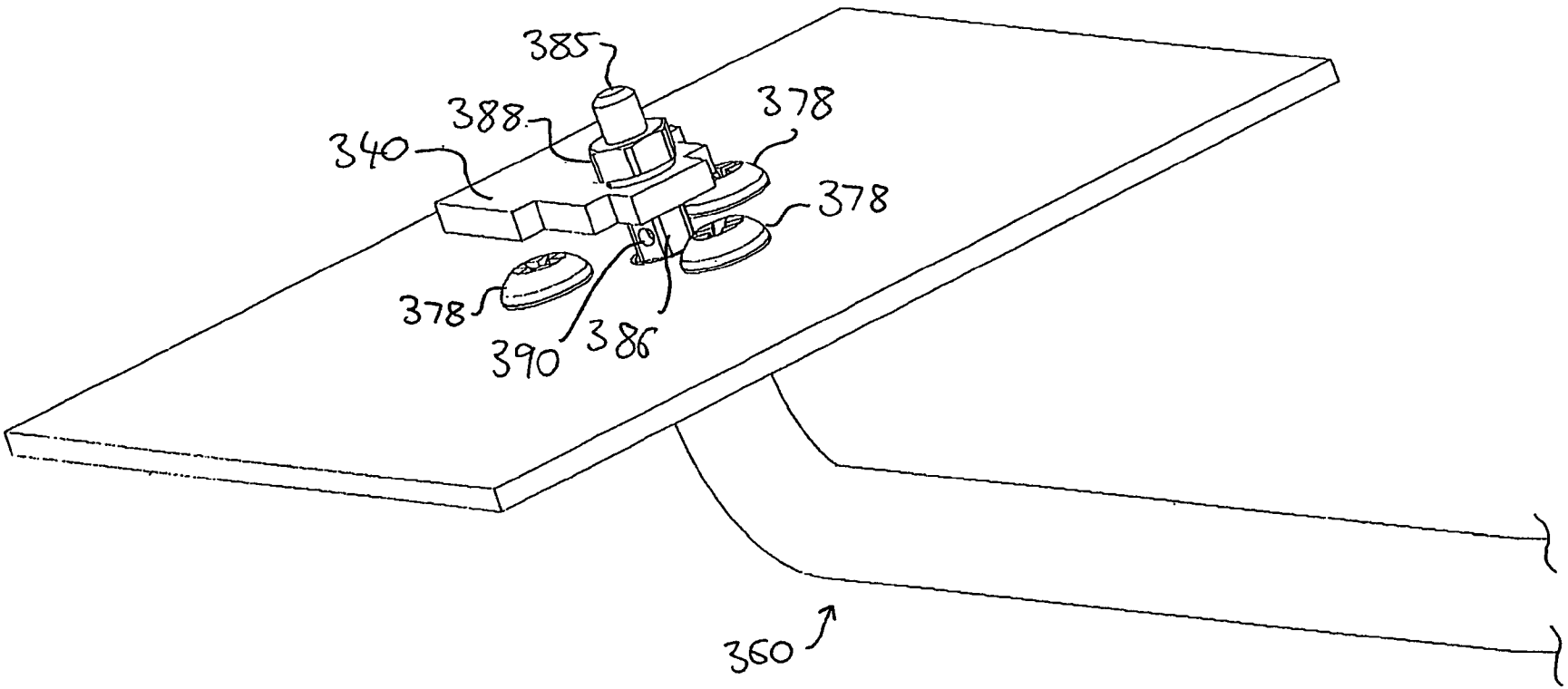
FIG. 13 is a second perspective view of the coaxial to microstrip transition of FIG. 9.

FIG. 8 shows a single dual polarization folded dipole antenna module 800 according to a second embodiment of the present invention. The ground plane and dielectric spacers are not shown. The antenna module 800 is identical to the module 500 shown in FIG. 5, except it is provided as a single self-contained module with inputs 840 and 841.

In a variable downtilt antenna (not shown), a number of single modules 800 can be arranged in a line and ganged together with cables, circuit-board splitters, and variable differential phase shifters for adjusting the phase between the modules. For instance, the differential phase shifters described in US2002/0126059A1 and US2002/0135524A1 may be used.

The transition coupling the coaxial transmission line 360 with the RF input section 340 is shown in FIGS. 9-13. The coaxial transmission line 360 has a central conductor 361 and a cylindrical coaxial conductive sheath 362 separated from the central conductor by a dielectric 363. An insulating jacket 364 encloses the sheath 362.

A metal ground transition body 370 has a cylindrical bore 371 which receives the sheath 362. The sheath 362 is soldered into the bore 371 by placing the cable into the bore, heating the joint and injecting solder through a hole 373 in the body 370 and into a gap 374 between the end of the body 370 and the jacket 364. The outer body 370 has an outer flange formed with a chamfered surface 372.

A metal transition ring 375 has a bore which receives the ground transition body 370. The bore has a chamfered surface 376 which engages the chamfered surface 372 of the body 370.

A plastic insulating washer 377 is provided between the transition ring 375 and the ground plane 101. The ground plane 101, washer 377 and transition ring 375 are provided with three holes which each receive an externally threaded shaft of a respective bolt 378.

The central conductor 361 extends beyond the end of the sheath, and is received in a bore of a plastic insulating collar 380. The collar 380 has a body portion received in a hole in the ground plane 101, and an outwardly extending flange 381 which engages an inwardly extending flange 382 of the ground transition body 370.

The three holes in the transition ring 375 are internally threaded so that when the bolts 378 are tightened, the chamfered surface 376 of the transition ring engages the chamfered surface 372 and forces the ground transition body 370 into conductive engagement with the ground plane 101. The chamfered surfaces 372,376 also generate a sideways centering force which accurately centers the coaxial cable.

It should be noted that this arrangement does not require any direct soldering between the ground transition body 370 and the ground plane 101.

A metal center pin 385 is formed with a relatively wide base 386 which is hexagonal in cross-section, a relatively narrow shaft 385 which is externally threaded and circular in cross-section, and a shoulder 389. The base 386 has a cup which receives the central conductor 361, which is soldered in place. Soldering is performed by first placing a bead of solder in the cup, then inserting the conductor 361, heating the joint and injecting solder through a hole 390 in the base 386. The shaft 385 passes through a hole in the RF input section 340, and through a metal locking washer 387 and hexagonal nut 388.

When the nut 388 is tightened, the shoulder 389 is forced into conductive engagement with the RF input section 340. The parts are precisely machined so as to provide a desired spacing between the ground plane 101 and RF input section 340.

It should be noted that this arrangement does not require any direct soldering between the ground center pin 385 and the RF input section 340.

The transition employs a mechanical joint between the ground plane 101 and the transition body 370, and between the center pin base 386 and the RF input section. These mechanical joints are more repeatable than the solder joints shown in the prior art. The pressure of the mechanical joints can be accurately controlled by using a torque wrench to tighten the nut 388 and bolts 378. The ground plane 101 and RF input section 340 can be formed from a metal such as Aluminum, which cannot easily form a solder joint.

An alternative dipole box configuration is shown in FIG. 14. In contrast to the "ring" structure shown in FIGS. 1,5 and 8, the radiating sections 301',302',401',402' are formed in a generally "square" structure. In common with the "ring" structure, the radiating sections are arranged in a "box" configuration around a central region. In a further alternative configuration (not shown) the four dipoles may be arranged in a "cross" configuration with the radiating sections extending radially from a central point.

Figure 15:
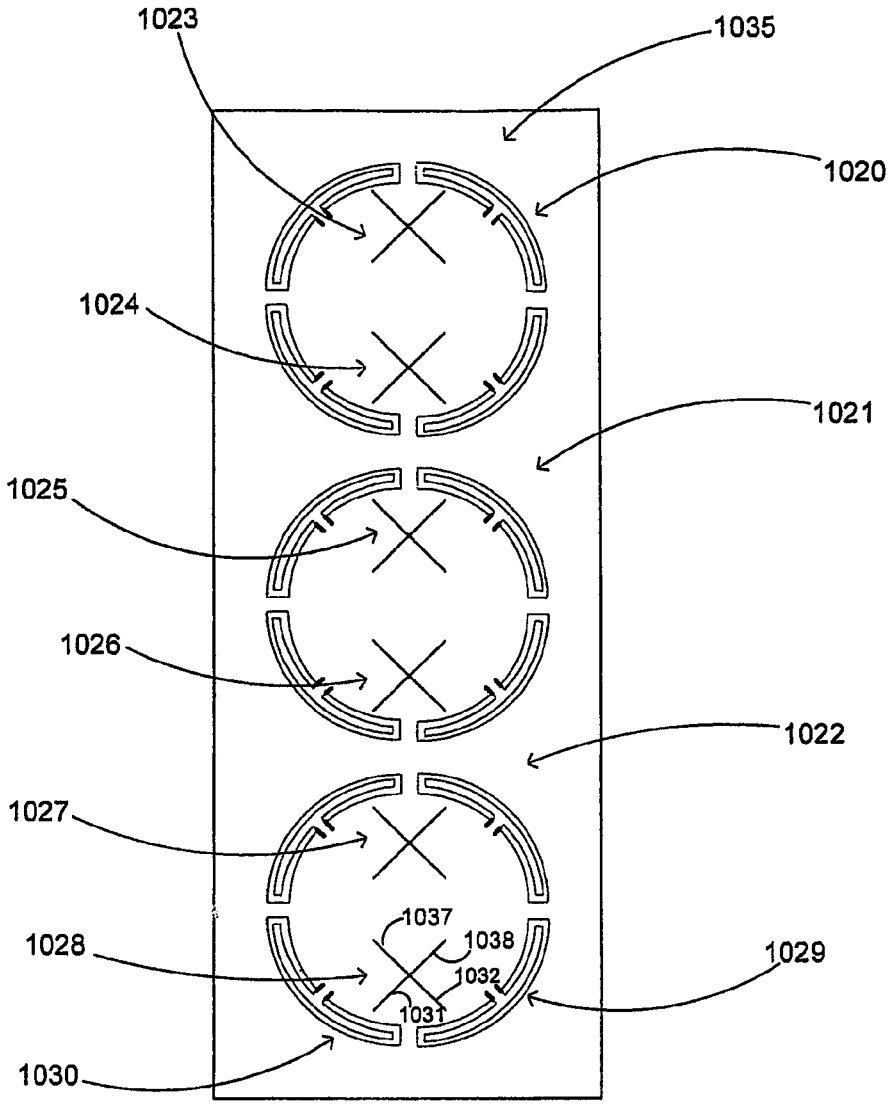
FIG. 15 is a plan view of a multi-band antenna having an array of dipole rings and an array of cross dipoles.

Referring now to FIG. 15, a dual band antenna is shown in which a low frequency array of dipole rings 1020, 1021 and 1022 has the same construction as the modules 500 shown in FIG. 1. Each ring defines an inner region within the ring providing a large area to accommodate further radiating elements of a high frequency array. The radiating elements of such further array may be dipole elements, patches or any other desired elements. In this embodiment a high frequency array of cross dipoles 1023-1028 is provided within the dipole rings. The high frequency array operates in a high frequency band having a mid-point frequency higher than the mid-point frequency of operation of the low frequency dipole ring array. The cross dipole array also provides slant 45 dual polarization.

Figure 16:
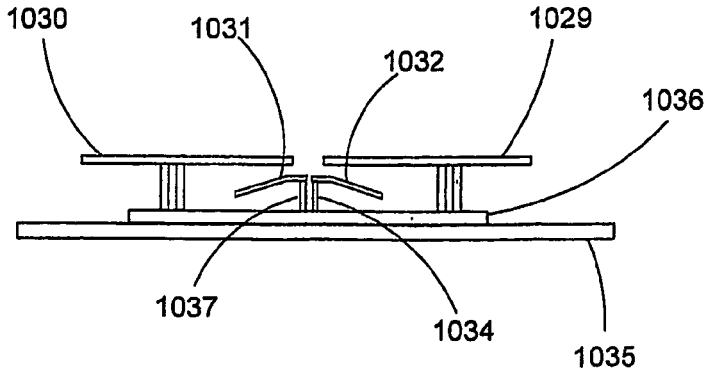
FIG. 16 is an end view of the antenna of FIG. 15.

The arrangement shown in FIGS. 15 and 16 has a number of desirable characteristics. Firstly, a dual band antenna is provided that is compact as the radiating elements of both bands can be contained within the same area. Secondly, the arrangement has good symmetry resulting in good isolation characteristics. The fact that no radiating element is positioned in the gaps between the dipole rings results in good symmetry and thus good isolation. The geometrical arrangement further allows the high frequency dipoles 1023-1028 to be evenly spaced, thus minimising grating lobes.

Referring to the end view shown in FIG. 16, cross dipole 1028 has arms 1031 and 1032 supported by feeds 1033 and 1034 respectively. The arms 1031 and 1032 are inclined downwardly towards ground plane 1035. The arms of the cross dipoles preferably incline towards ground plane 1035 by about 20°. The geometry allows PCB feed network 1036 to be kept relatively compact with one PCB feeding each dipole ring and elements within the ring.

Figure 17:
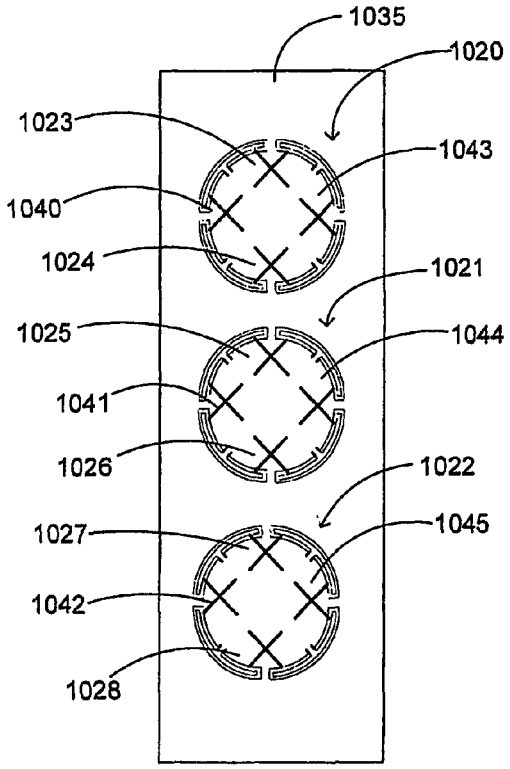
FIG. 17 is a plan view of a multi-band antenna having an array of ring dipoles and three linear arrays of cross dipoles.

Referring now to FIG. 17 a third embodiment is shown which is a modification of the embodiment shown in FIG. 15. Like integers have been given like numbers. In this embodiment two additional arrays of cross dipoles have been added to the embodiment shown in FIG. 17. A first array of cross dipoles 1040, 1041 and 1042 is provided to the left and a second array of cross dipoles 1043, 1044 and 1045 is provided to the right. By adjusting power division or phase shift between first array 1040, 1041 and 1042, second array 1023-1028 and third array 1043-1045, beam width may be adjusted or azimuth steering may be provided. Various feed arrangements for adjusting beam width or effecting azimuth and/or downtilt steering are disclosed in the Applicant's PCT application no. PCT/NZ01/00137, the disclosure of which is hereby incorporated by way of reference. Such techniques may also be utilised with the multi array embodiments described hereafter. Beam width/angle control may be effected using a remotely controlled electromechanical motor (not shown) mounted on the back of the antenna ground plane, as described in more detail in PCT/NZ01/00137 and PCT/NZ95/00106, the disclosure of which is also hereby incorporated by way of reference.

The arrangement shown in FIG. 17 has good symmetry with no radiating element at the middle of any dipole ring and no radiating elements between dipole rings. This results in good isolation characteristics. Further, the cross dipoles 1023-1028 of the main array are evenly spaced to minimize grating lobe potential.

Figure 18:
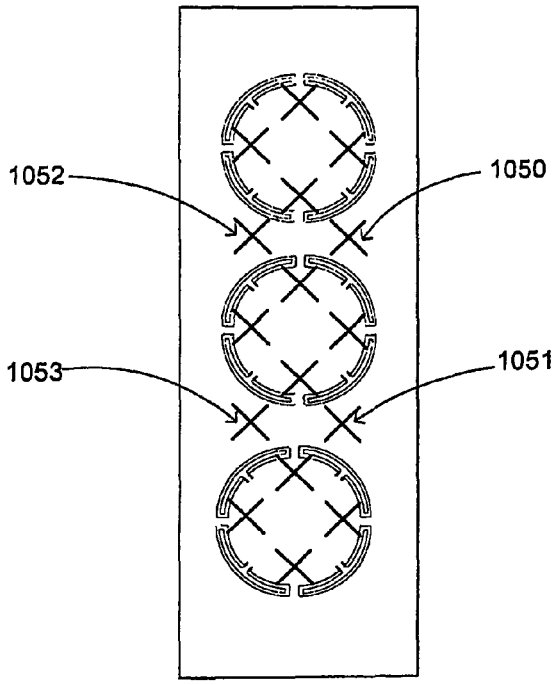
FIG. 18 is a plan view of a multi-band antenna having an array of ring dipoles and three linear arrays of cross dipoles, including cross dipoles between dipole rings.

The further embodiment of FIG. 18 is a modification of the embodiment shown in FIG. 17 and only the additional elements have been referenced. In this embodiment additional cross dipoles 1050-1053 are provided in the outer cross dipole arrays. These enhance control of beam width and azimuth beam steering and reduce the effect of grating lobes in the outer cross dipole arrays.

Figure 19:
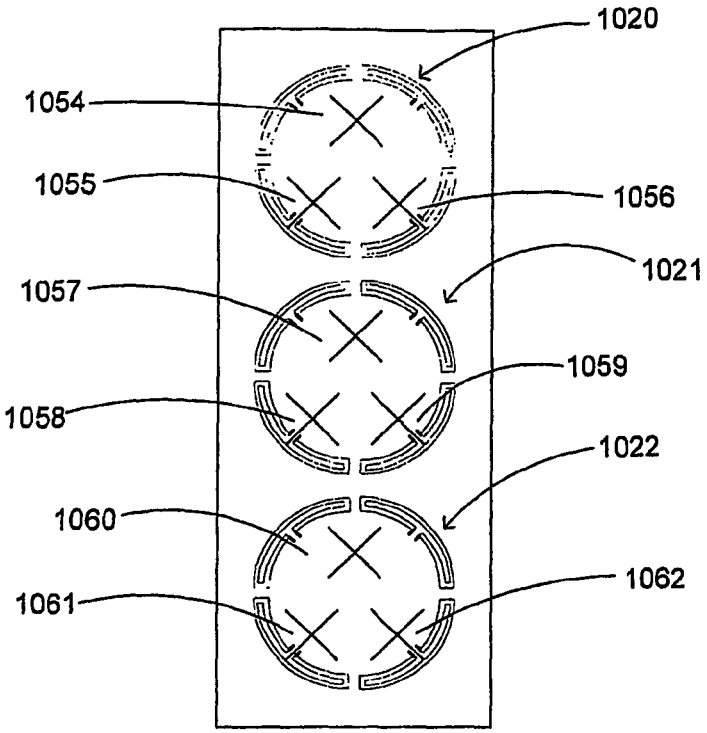
FIG. 19 is a plan view of a multi-band antenna including an array of dipole rings having three cross dipoles within each ring.

FIG. 19 shows a further embodiment, similar to the embodiment shown in FIGS. 15 and 16, in which three cross dipoles are provided within each dipole ring instead of two. Like integers have been given like numbers to those in FIG. 15. In this embodiment three linear arrays of cross dipoles 1055, 1058 and 1061; 1054, 1057 and 1060; and 1056, 1059 and 1062 are provided. Each array is evenly spaced to reduce grating lobes. All of the cross dipoles are located within the dipole rings and are equidistant from the centre of the ring so as to form an equilateral triangle shape which has good symmetry and thus good isolation characteristics.

Figure 20:
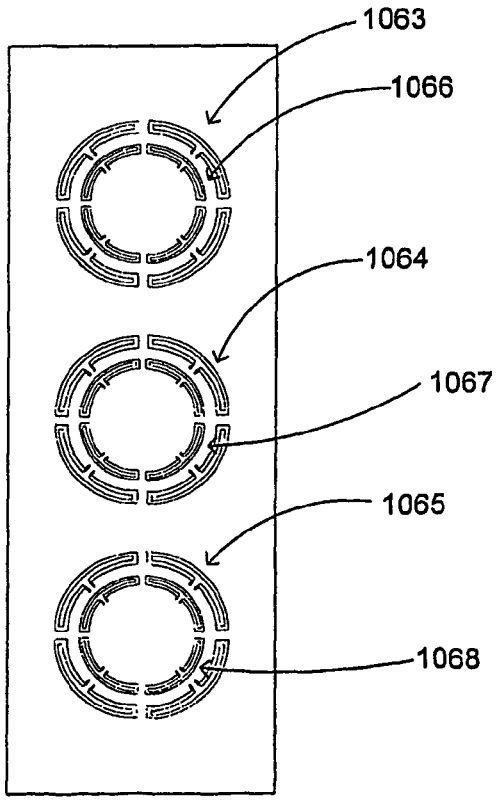
FIG. 20 is a plan view of a multi-band antenna in which each of the dipole rings of a first array of ring dipoles are located concentrically within each dipole ring of a second array of dipole rings.

FIG. 20 shows a sixth embodiment comprising a first array of dipole rings for operation over a first frequency band and a second array of dipole rings 1066, 1067 and 1068 operable over a second frequency band having a mid-frequency higher than the mid-frequency of the first frequency band. All dipole rings employ curvilinear folded dipoles of substantially quarter circle segments. The arrangement has good symmetry and thus good isolation characteristics.

Figure 21:
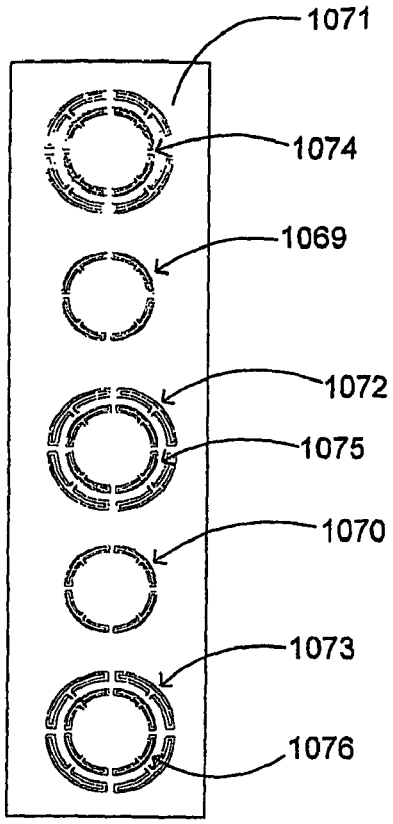
FIG. 21 is a plan view of a multi-band antenna, in which high frequency dipole rings are provided between low frequency dipole rings.

The further embodiment shown in FIG. 21 is similar to the embodiment shown in FIG. 20 except that additional high band dipole rings 1069 and 1070 are provided in the gaps between low frequency dipole rings 1071-1073. The array of high frequency dipole rings 1074, 1069, 1075, 1070 and 1076 may be spaced so as to avoid grating lobes. It will be appreciated that additional high frequency band dipole rings may be placed between low frequency band dipole rings in other embodiments herein described also.

Figure 22:
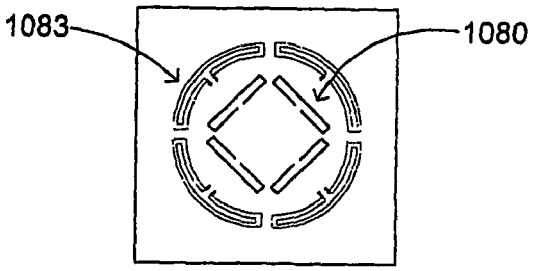
FIG. 22 is a plan view of a multi-band antenna module in which the inner dipole box is a dipole square formed of linear folded dipoles.

Referring now to FIG. 22 an antenna module is shown comprising a dipole square 1080 oriented to provide slant 45 polarization, and a ring 1083.

Figure 23:
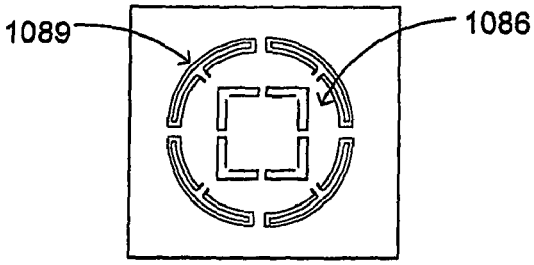
FIG. 23 is a plan view of a multi-band antenna module in which the inner dipole box is a dipole square formed of bent folded dipoles.

FIG. 23 shows an antenna module, which is a variant of the module shown in FIG. 22, in which the dipole square 1080 is replaced with a dipole square 1086 consisting of four bent folded dipoles. Each bent folded dipole has a pair of straight arms disposed at about 90° to one another and meeting at a corner. Thus the bent folded dipoles each have a generally V-shaped profile as viewed along the axis of propagation of the dipole, perpendicular to the ground plane.

Figure 24:
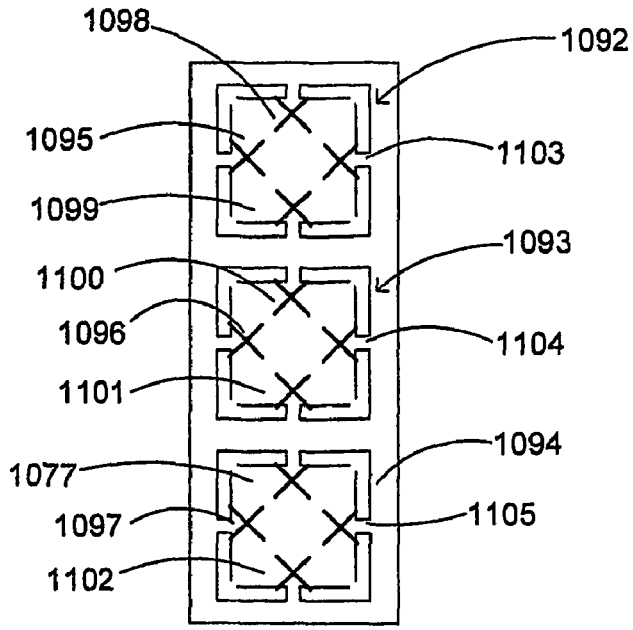
FIG. 24 is a plan view of a multi-band antenna including a first array of bent folded dipole squares and three linear arrays of cross dipoles.

FIG. 24 shows an embodiment in which a low band array consists of an array of bent folded dipole squares 1092, 1093 and 1094 and three high frequency arrays are formed by cross dipoles 1095-1097; 1098-1102, 1077; and 1103-1105. Bent folded dipole squares 1092, 1093 and 1094 provide a geometry that allows the squares to be closely spaced together whilst providing a large inner region to accommodate high frequency radiating elements. The arrangement provides two dual polarization slant 45 antennas for operation over different frequency bands. The symmetry of the arrangement provides good isolation.

Figure 25:
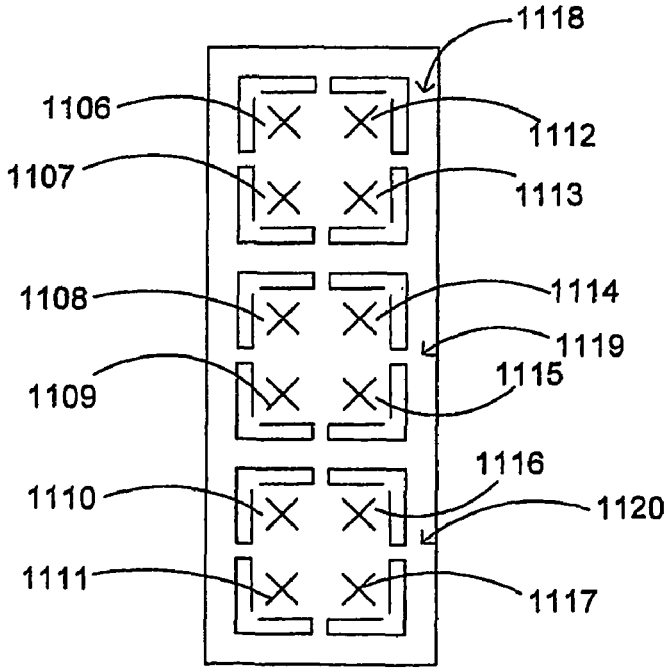
FIG. 25 is a plan view of a multi-band antenna in which the cross dipoles are in a square rather than diamond formation within each dipole square.

The embodiment shown in FIG. 25 employs a square arrangement of cross dipoles within each square instead of a diamond arrangement. This results in two cross dipole arrays 1106-1111 and 1112-1117 within bent folded dipole squares 1118-1120.

Figure 26:
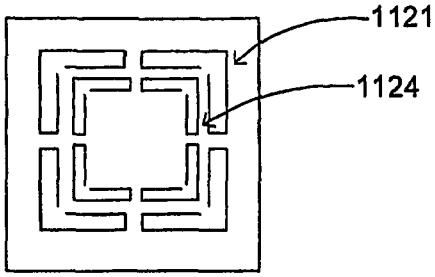
FIG. 26 is a plan view of a multi-band antenna module consisting of two concentric bent folded dipole squares.

Referring now to FIG. 26 an antenna module is shown consisting of a low frequency band dipole square 1121 and a high frequency band dipole square 1124. The dipole squares are formed from bent folded dipoles and are arranged concentrically.

Figure 27:
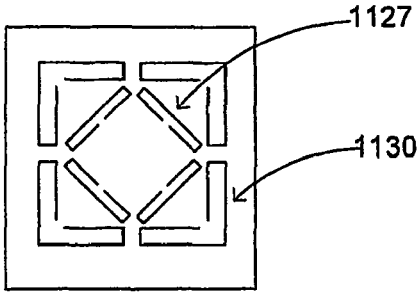
FIG. 27 is a plan view of a multi-band antenna module, in which the inner dipole square is formed of linear folded dipoles rather than bent folded dipoles.

FIG. 27 shows a modified antenna module in which the high frequency dipole square 1127 is formed of linear folded dipoles, whilst the low frequency dipole square 1130 is formed of bent folded dipoles.

Figure 28:
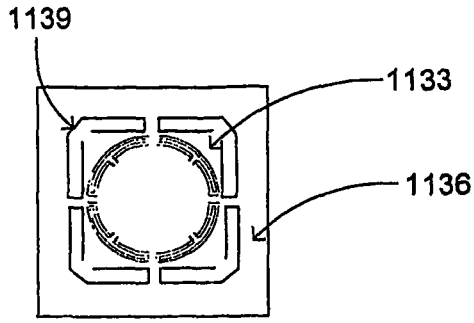
FIG. 28 is a plan view of a multi-band antenna module in which the inner dipole box is formed of curvilinear folded dipoles rather than bent folded dipoles.

FIG. 28 shows a further variant in which the high frequency band element is a dipole ring 1133 whilst the low frequency dipole square 1136 is formed of bent folded dipoles. Also, the bent folded dipoles forming the dipole square 1136 have truncated comers 1139.

Figure 29:
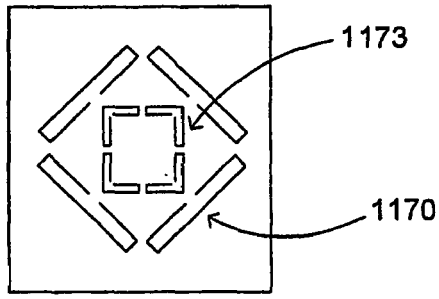
FIG. 29 is a plan view of a multi-band antenna module including a first dipole square formed of linear folded dipoles and a second dipole square formed of bent folded dipoles.

FIG. 29 shows a further embodiment in which the high frequency band element is a bent folded dipole square 1173 and the low frequency band element is a linear folded dipole square 1170.

Figure 30:
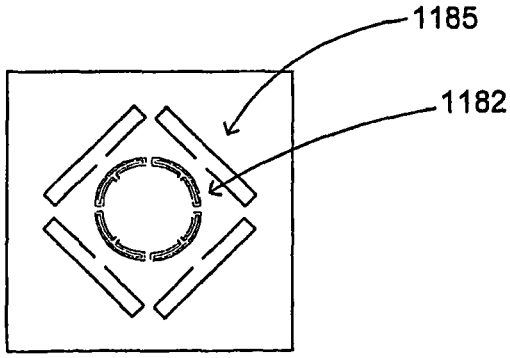
FIG. 30 is a plan view of a multi-band antenna module in which the inner dipole square of FIG. 29 is replaced by a ring of curvilinear folded dipoles.

FIG. 30 shows a further variant in which the high frequency band radiating element is a dipole ring 1182 and the low frequency band radiating elements is a linear folded dipole square 1184.

FIGS. 22,23 and 26-30 each show various single antenna modules, consisting of a concentric pair of dipole boxes. A dual band antenna may be constructed using a single module only. Alternatively, an array antenna may be constructed using an array of the modules of FIGS. 22, 23 and 26-30, with an additional high frequency radiating dipole box positioned between each module (as shown in FIG. 21). The additional high frequency dipole box is required so that the centre-to-centre spacing of the high frequency elements is approximately half the centre-to-centre spacing of the low frequency elements, so that in wavelength terms the centre-to-centre spacing is approximately equal.

Figure 31:
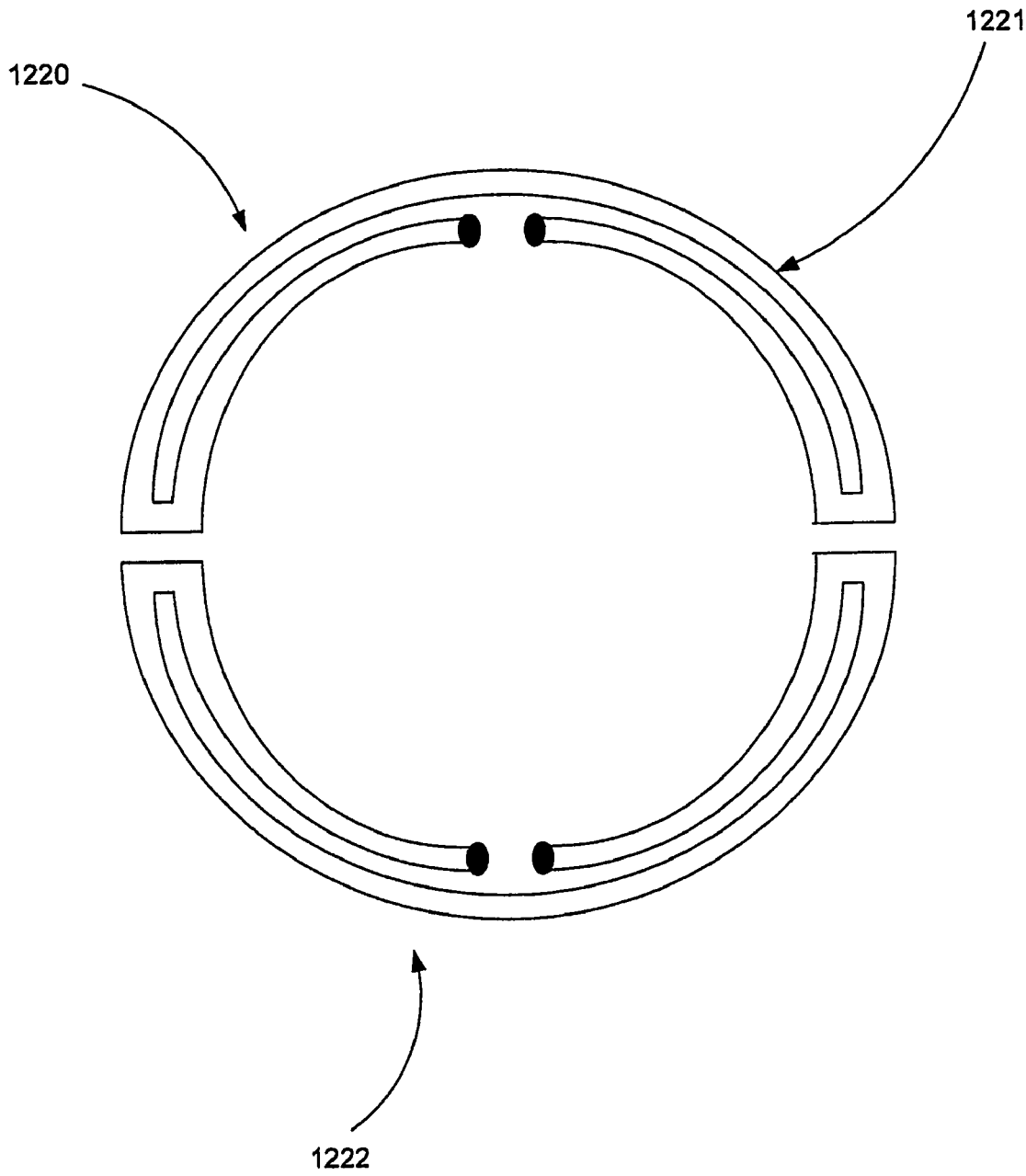
FIG. 31 shows an alternative dipole ring consisting of two semicircular folded dipoles.

A further alternative dipole ring 1220 is shown in FIG. 31. The ring consists of two curved folded dipoles 1221,1222. The dipoles 1221,1222 are identical in construction to the dipoles shown in FIG. 15, except the dipole arms extend over a semi-circle.

Figure 32:
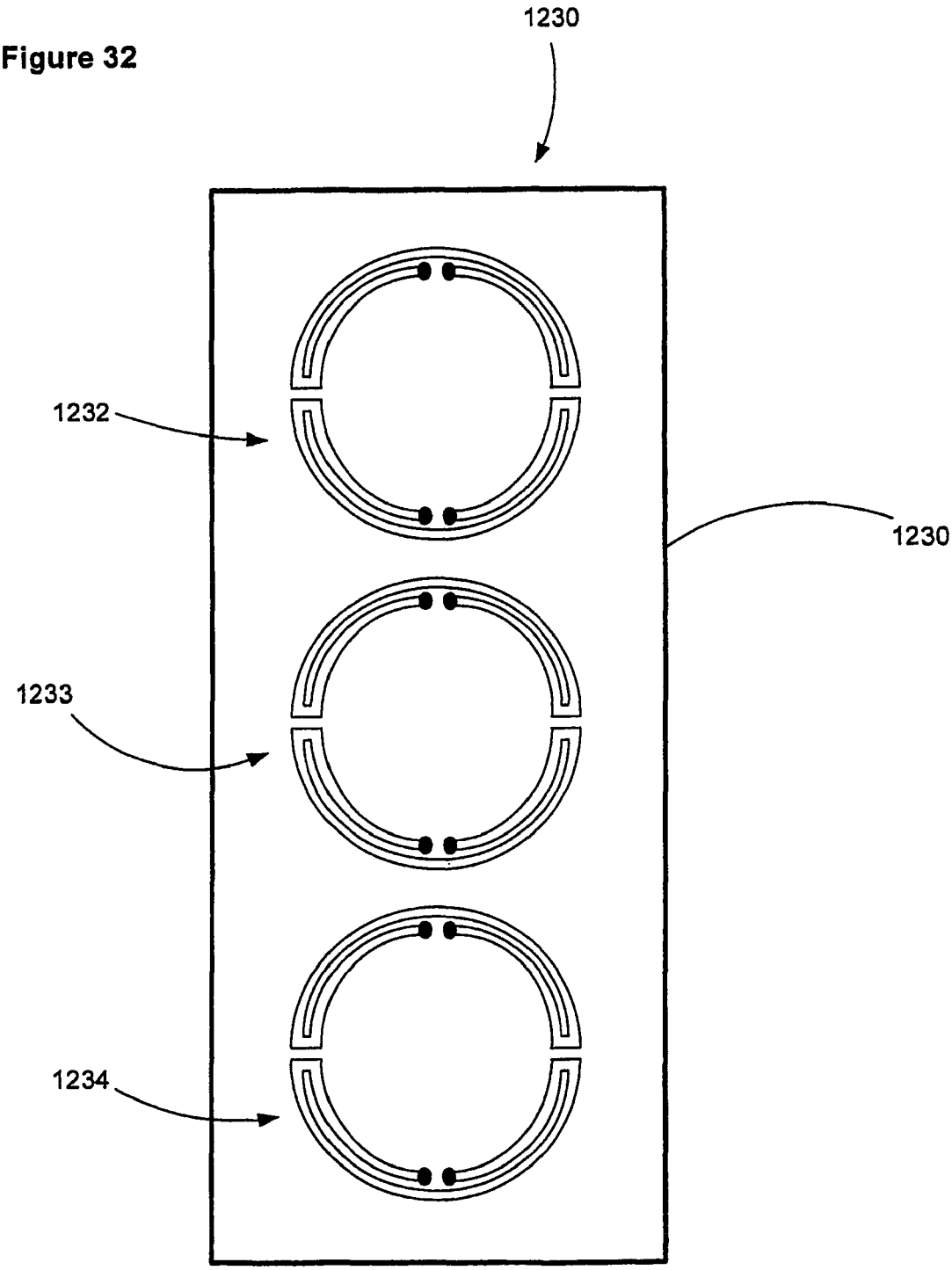
FIG. 32 shows an array of dipole rings of the type shown in FIG. 31.

A panel antenna 1230 shown in FIG. 32 has a ground plane 1231 and three dipole rings 1232-1234 each consisting of two semicircular dipoles.

Figure 33:
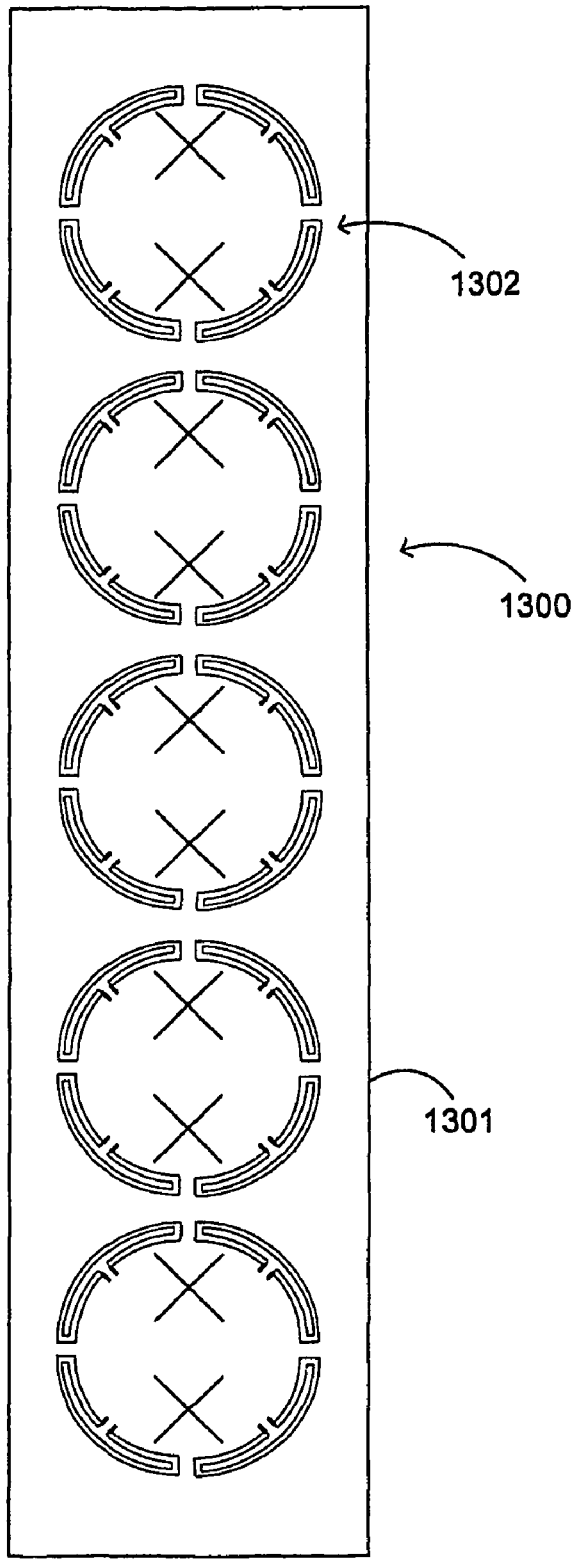
FIG. 33 is a plan view of a multi-band antenna.
Figure 34:
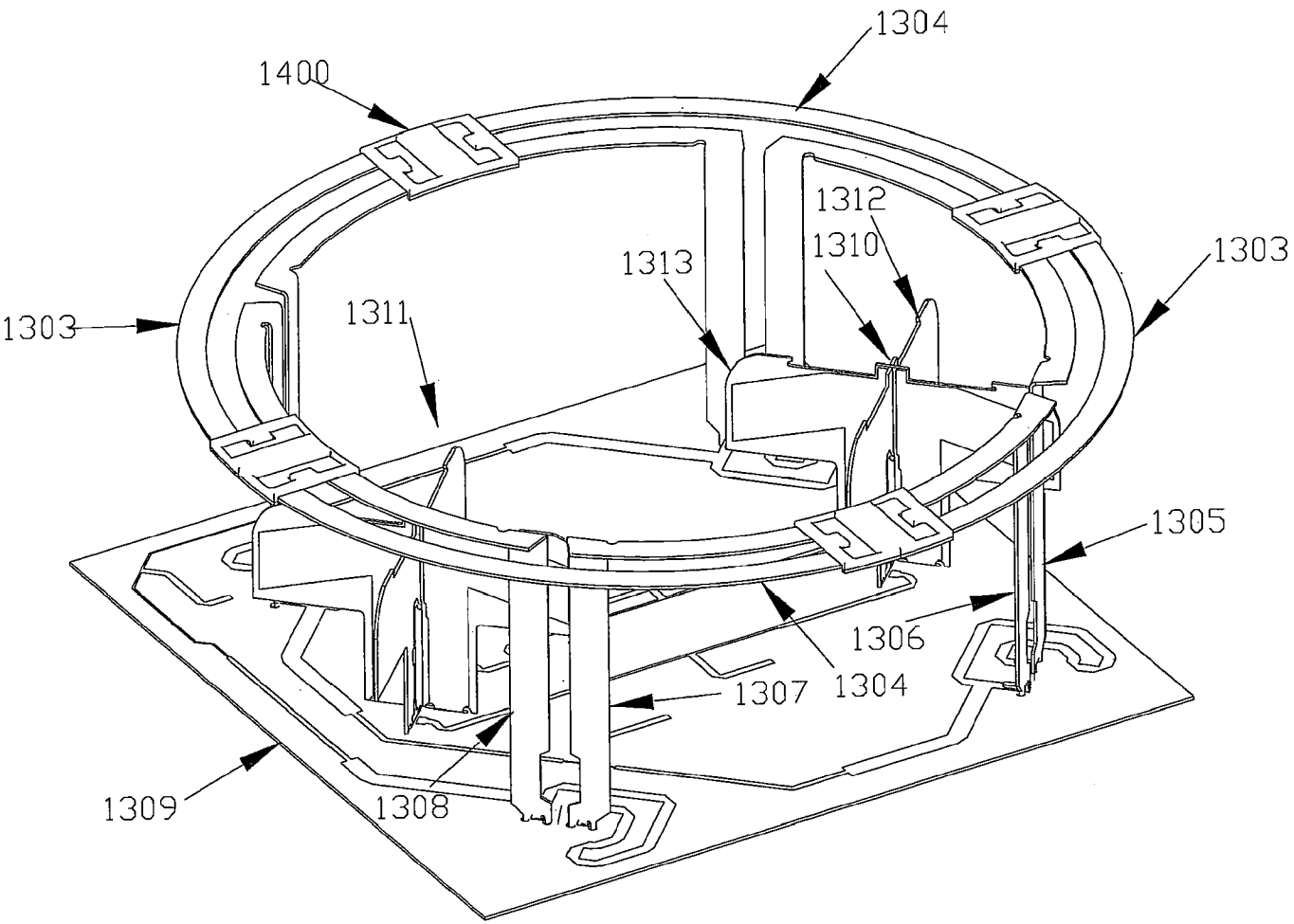
FIG. 34 is a perspective view of a single antenna module.

A further embodiment is shown in FIG. 33. The antenna 1300 has a back panel 1301 carrying five identical modules 1302, one of which is shown in detail in FIGS. 34-37. Module 1302 has a dipole ring consisting of two +45° folded dipoles 1303 and two −45° folded dipoles 1304. Feed legs 1305-1308 are connected to a printed circuit board (PCB) 1309 as shown. The dipole arms and feeds are formed by stamping from a single sheet of metal and folding the feed legs by 90°.

A pair of high frequency cross dipoles 1310,1311 is provided within the dipole ring. Each cross dipole has a +45° dipole and a −45° dipole formed as copper strips deposited on insulating boards 1312,1313. Each dipole is driven by a respective balun feedline deposited on the other side of the insulating board. FIG. 36 is a side view of cross dipole 1311 as viewed from the centre of FIG. 35. Insulating board 1313 carries a balun feedline 1320 shown in FIG. 36 which leads to a quarterwave open-circuit stub portion (hidden behind the other insulating board 1312 in FIG. 36). Insulating board 1312 carries a balun feedline (hidden behind the other insulating board 1313 in FIG. 36) and a quarterwave open-circuit stub portion 1321. The balun feedline and quarterwave open-circuit stub portions couple capacitively with the dipoles printed on the other side of the insulating board. The two balun feedlines and open-circuit portions are arranged in a typical cross over/cross under fashion.

Figure 38:
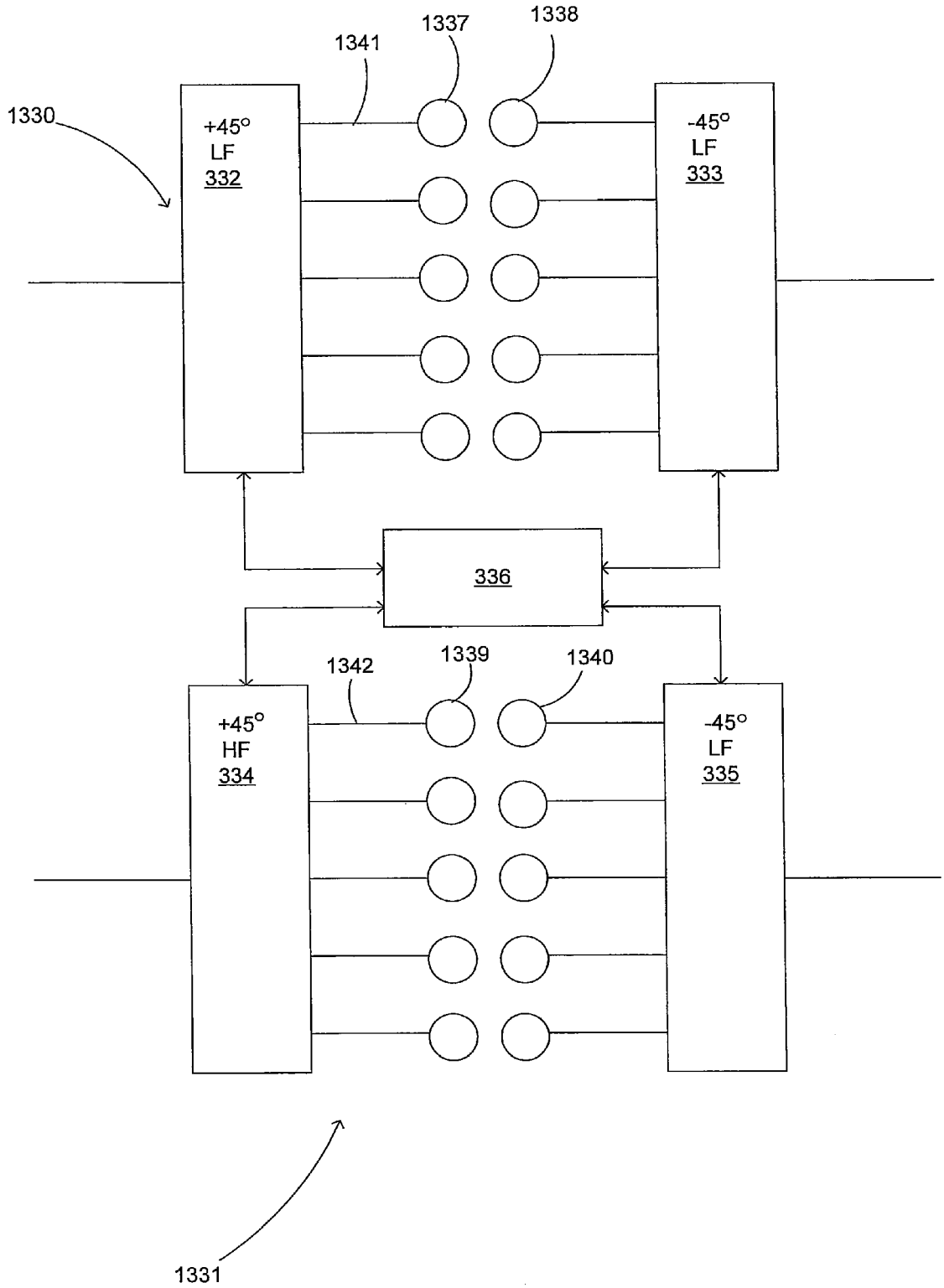
FIG. 38 shows a schematic view of an antenna feed network for feeding the antenna of FIG. 33.

The antenna is driven by a feed network illustrated schematically in FIG. 38. The low frequency dipole rings are driven by feed network 1330, and the high frequency crossed dipoles are driven by feed network 1331. Each feed network has a respective pair of feedlines which input into downtilt phase shifters 1332-1335. Each phase shifter 1332-1335 has a single input feedline and five antenna output lines 1341, 1342. A progressive phase shift is introduced on the five antenna output lines to produce variable downtilt. The degree of downtilt is controlled remotely by a controller 1336 as described in more detail in PCT/NZ01/00137 and PCT/NZ95/00106. The four phase shifters 1332-1335 may be driven together or independently. The phase shifter 1332 is connected to the ten low frequency +45° folded dipoles 303 via power splitters 1337. The phase shifter 1333 is connected to the ten low frequency −45° folded dipoles 1304 via power splitters 1338. The phase shifter 1334 is connected to the ten high frequency +45° dipoles 1313 via power splitters 1339. The phase shifter 1335 is connected to the ten high frequency −45° dipoles 1312 via power splitters 1340.

Figure 35:
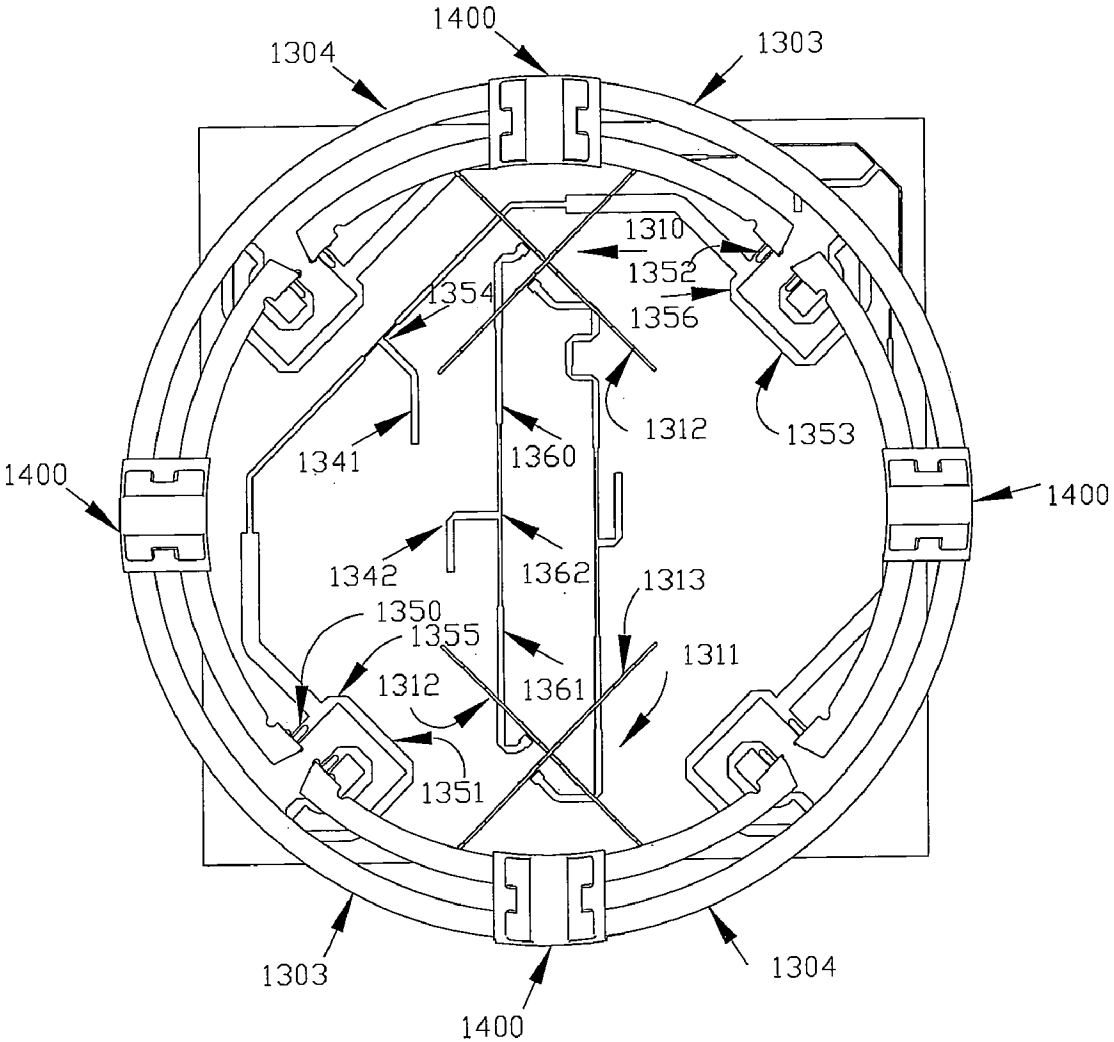
FIG. 35 is a plan view of the module of FIG. 34.
Figure 36:
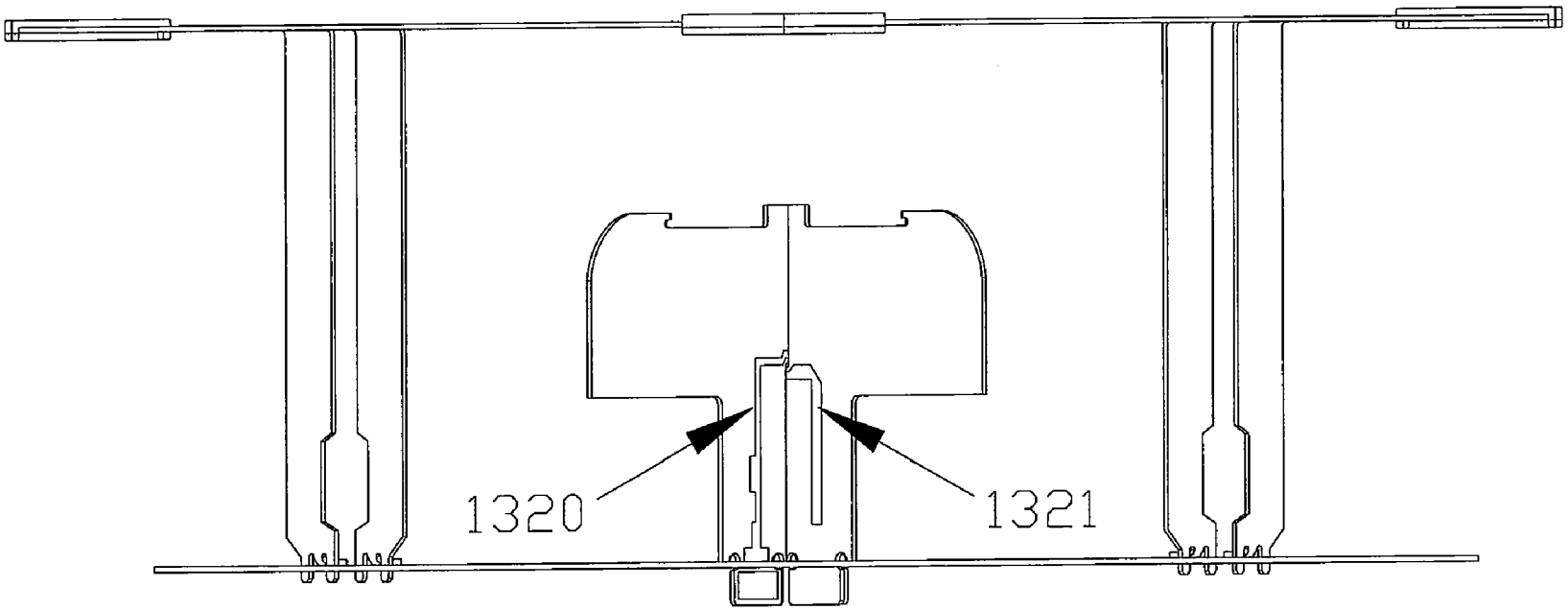
FIG. 36 is a view of one of the cross dipoles of FIG. 34 viewed from the centre of the module.

The power splitters 1337-1340 are shown in detail in FIG. 35. Feedline 1341 is coupled to four lines 1350-1353 via T-junctions 1354-1356. Each line 1350-1353 is coupled to a respective dipole feed leg 1305-1308. Lines 1353 and 1351 are longer than lines 1350,1352, and thus introduce a 1800 phase shift between the respective pair of dipole feed legs. Feedline 1342 is coupled to a pair of lines 1360,1361 via T-junction 1362. Each line 1360,1361 is coupled to a respective dipole 1312. As shown in the side view of FIG. 36, the dipoles are balun fed by a balun feedline 1320 coupled to a respective line 1360 or 1361.

Figure 39:
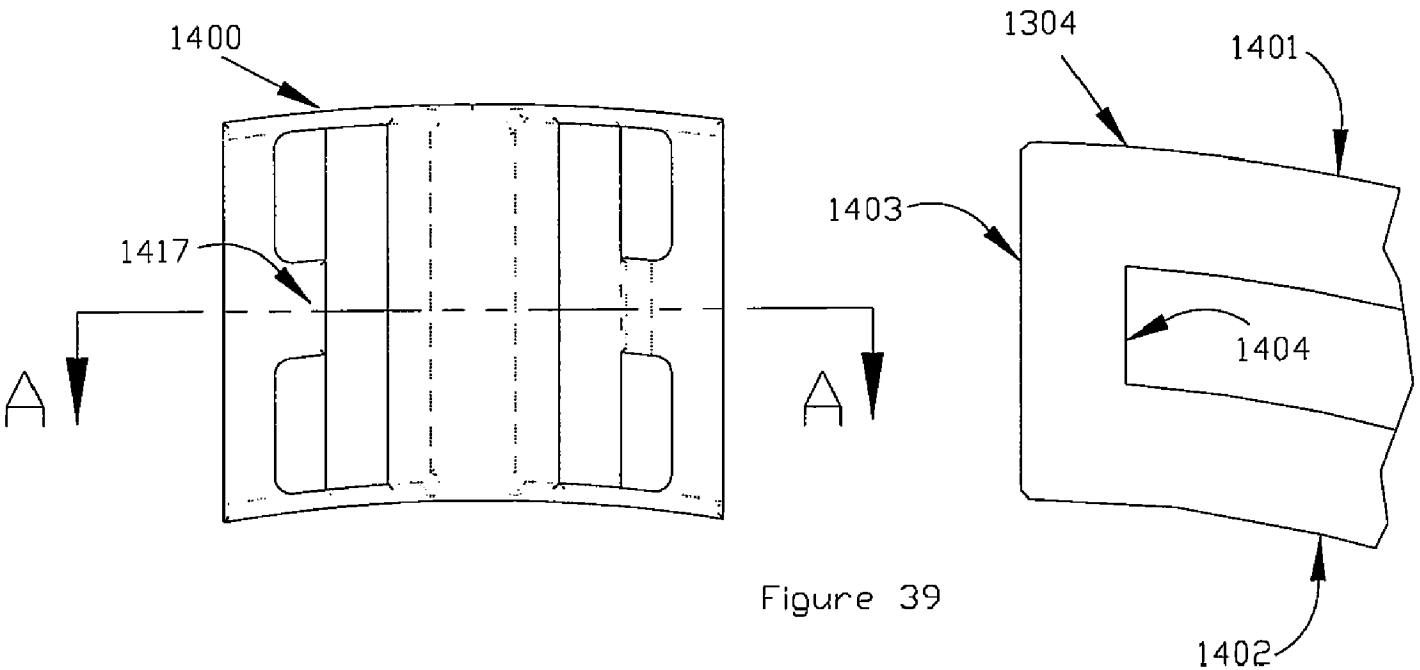
FIG. 39 shows a plan view of a clip with a dipole arm being inserted.
Figure 40:
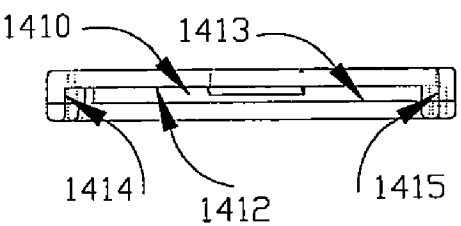
FIG. 40 shows an end view of the clip.
Figure 41:
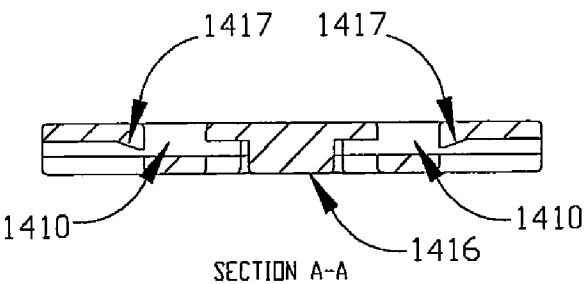
FIG. 41 shows a cross-section through the clip along a line A-A in FIG. 39.

The folded dipoles 1303,1304 are retained together by insulating clips 1400 shown in detail in FIGS. 39-41. The dipole 1304 is shown being inserted into the clip 1400 in FIG. 39. The arm of the dipole 1304 shown in FIG. 39 has a pair of strips 1401,1402 which meet at a folded end 1403 having a distal outer edge, and a proximal inner edge 1404.

The clip 1400 has a frame portion formed by convex outer side wall 1415, concave inner side wall 1414, and a pair of end walls 1412. The side walls 1414,1415 are joined by a dividing wall 1416 and a pair of lateral strips 1413. Each end wall 1412 is formed with a pair of tabs 1417 which are bent down as shown in FIG. 41. The end 1403 of the folded dipole 1304 is inserted into slot 1410 between tab 1417 and dividing wall 1416 with the tab 1417 folded down. The dipole 1301 is then pulled back slightly so that the inner edge 1404 of the folded end engages the tab 1417 to lock the dipole in place.

Four circular notches 1418 are provided between dividing wall 1416 and side walls 1414,1415. The purpose of the circular notches is for tolerance matching between mating parts. The circular notches help the parts mate together in case there is a burr or sharp corner to the corner of the dipole arm 1304 where the pair of strips 1401, 1402 meet the folded end 1403

For proper molded parts, it is important to keep all walls the same thickness from a point of view of shrink during cooling. Therefore the dividing wall 1416 is T-shaped in cross-section and a slot (not labelled) is formed between the dividing walls and the lateral strips 1413. The other reason for this design is to make the mold tool an easier, cheaper tool given the hooking function of the clip.

The antennas shown in the Figures are designed for use in the "cellular" frequency band: that is 806-960 MHz. Alternatively the same design (typically the cabled together version with a PCB power splitter) may operate at 380-470 MHz. Another possible band is 1710-2170 MHz. However, it will be appreciated that the invention could be equally applicable in a number of other frequency bands.

Figure 42:
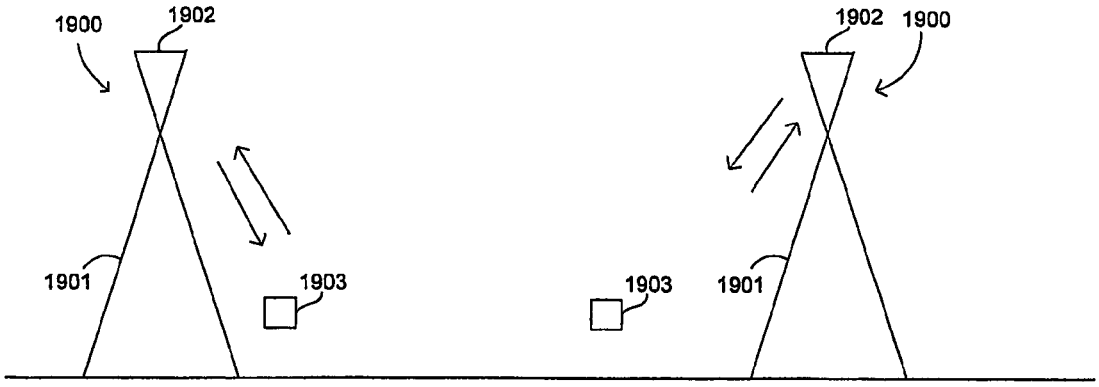
FIG. 42 is a schematic side view of a pair of base stations.

The preferred field of the invention is shown in FIG. 42. The antennas are typically incorporated in a mobile wireless communications cellular network including base stations 1900. The base stations include masts 1901, and antennas 1902 mounted on the masts 1901 which transmit and receive downlink and uplink signals to/from mobile devices 1903 currently registered in a "cell" adjacent to the base station.

Although many of the embodiments show three low band dipole boxes it will be appreciated that any number of dipole boxes may be employed. Further, it will be appreciated that high band elements may be provided between the low band dipole boxes of the embodiments of FIGS. 19,20 and 22-30, as per the embodiments of FIGS. 18 and 21.

The invention provides antennas having at least two frequency bands, and dual polarization (slant 45) performance within a compact assembly. The dipole ring or square structure provides a large inner region for accommodating secondary radiating elements of one or more second array. By accommodating secondary radiating elements within the dipole boxes, isolation may be improved. By adopting symmetrical placements of secondary radiating elements within the dipole boxes good isolation can be achieved. The arrangement allows secondary radiating elements to maintain a uniform spacing whilst being located within the dipole boxes, thus reducing the effect of grating lobes.

While the present invention has been illustrated by the description of the embodiments thereof, and while the embodiments have been described in detail, it is not the intention of the Applicant to restrict or in any way limit the scope of the appended claims to such detail. Additional advantages and modifications will readily appear to those skilled in the art. Therefore, the invention in its broader aspects is not limited to the specific details, representative apparatus and method, and illustrative examples shown and described. Accordingly, departures may be made from such details without departure from the spirit or scope of the Applicant's general inventive concept.

For instance, sub-reflectors may be employed to achieve desired beam patterns. Thus, for example, each cross dipole may be framed by four conductive side walls which broaden the beam width and improve isolation.

The feed network shown is a microstrip configuration: that is, the PCB 309 is a dielectric substrate which carries conductive microstrip feedlines on its upper face shown in FIGS. 22 and 23, and carries a conductive ground plane (for instance a layer of copper) on its reverse side (not shown). In an alternative air-suspended microstrip configuration, the conductive microstrip is separated from the ground plane by an air gap.

Figure 37:
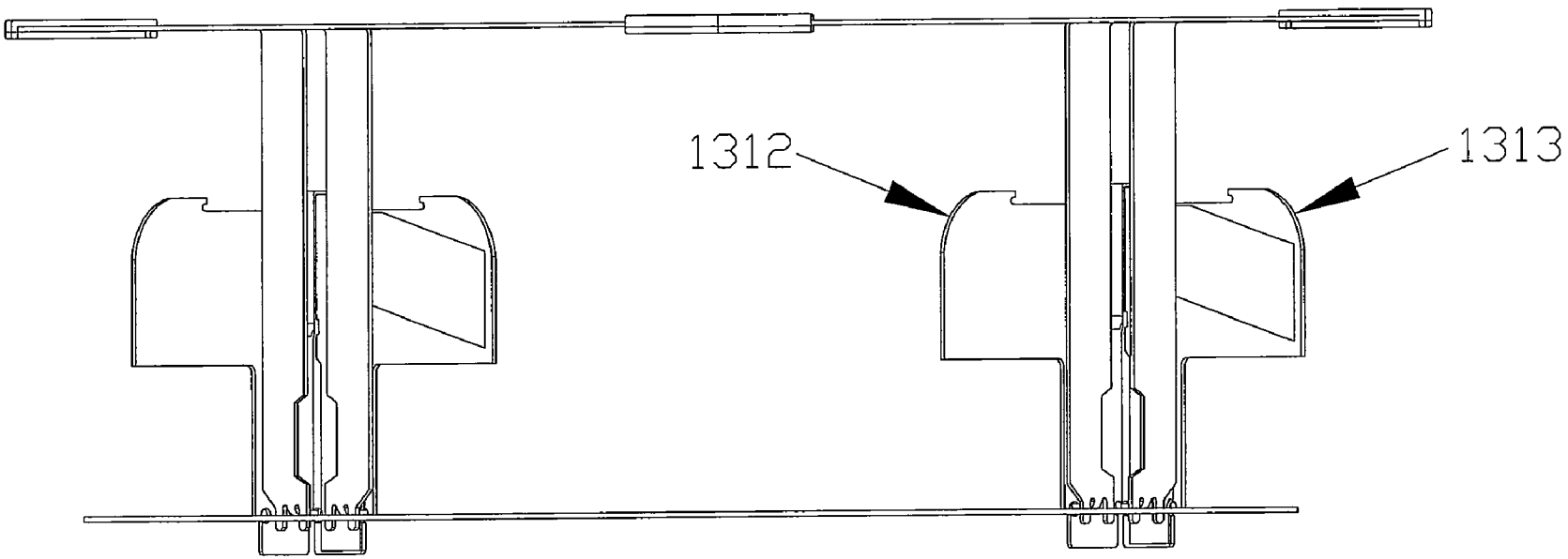
FIG. 37 shows a side view of the module of FIG. 34.

The high frequency cross dipoles lie closer to the ground plane than the low frequency folded dipoles, as shown most clearly in FIGS. 36 and 37. However, in alternative embodiments (not shown) the height of the feed legs 1305-1308 may be reduced from the height shown. In extreme cases it is possible that the low frequency folded dipoles may lie closer to the ground plane than the high frequency cross dipoles. In this case, the cross dipoles will be mounted closer together to provide sufficient clearance.

Although dielectric clips are used to couple together adjacent pairs of dipole arms in the embodiments shown above, in an alternative embodiment the clips may be omitted. Further more, although the arms of the folded dipoles lie parallel with the ground plane, they may lie at an angle to the ground plane. Alternatively, each arm of the folded dipole may have a proximal portion parallel with the ground plane, and an end portion which is folded down at 90 degrees towards the ground plane. This increases the length of the dipole arms whilst maintaining compactness.

The clip shown in the Figures has a concave edge and a convex edge so as to fit within a circular ring configuration. Optionally the clip may have straight sides and perform the same function/fit for the square dipole configurations.

Specific embodiments of improvements to dipole antennas according to the present invention have been described for the purpose of illustrating the manner in which the invention may be made and used. It should be understood that implementation of other variations and modifications of the invention and its various aspects will be apparent to those skilled in the art, and that the invention is not limited by the specific embodiments described. It is therefore contemplated to cover by the present invention any and all modifications, variations, or equivalents that fall within the true spirit and scope of the basic underlying principles disclosed and claimed herein.

What is claimed is:

1. A folded dipole comprising a fed dipole fed at a center of the fed dipole and a passive dipole being continuous from one end to the other end of the passive dipole, the fed dipole and passive dipole separated by a gap and connected at ends of the fed dipole and the ends of passive dipole, the folded dipole having an axis of propagation defining a dipole axis, the folded dipole comprising a pair of arms which together have a profile which is concave on one side and convex on the other when viewed along the dipole axis.

2. A folded dipole according to claim 1 wherein the arms are at least partially curved.

3. A folded dipole according to claim 2 wherein the arms have curved portions which have a substantially constant radius of curvature.

4. A folded dipole according to claim 2 wherein the aims are at least partially curved in a plane substantially orthogonal to the dipole axis.

5. A folded dipole according to claim 1 wherein the pair of arms meets at a corner.

6. A folded dipole according to claim 5 wherein the corner subtends an angle lying in the range of 80° to 100°.

7. A folded dipole according to claim 5 wherein each arm is substantially straight.

8. A folded dipole according to claim 5 wherein the corner is truncated.

9. A folded dipole according to claim 1 further comprising an input section coupled to a concave side of the pair of arms.

10. A folded dipole according to claim 1 wherein the pair of arms are formed of sheet material.

11. A folded dipole according to claim 10 wherein both arms are formed from the same sheet.

12. A folded dipole according to claim 1 further comprising a first feed leg coupled to one of the arms and a second feed leg coupled to the other arm.

13. An antenna comprising a ground plane; and a folded dipole according to claim 1 arranged with its dipole axis directed away from the ground plane.

14. A base station including an antenna according to claim 13.

15. A communication system including a network of base stations according to claim 14.

16. A dipole box comprising two or more folded dipoles arranged around a central region, each folded dipole comprising a fed dipole fed at a center of the fed dipole and a passive dipole being continuous from one end to the other end of the passive dipole, the fed dipole separated by a gap and connected at ends of the fed dipole and the ends of passive dipole, the folded dipole having a dipole axis and a pair of arms which together have a profile which is concave on one side and convex on the other when viewed in plan.

17. A dipole box according to claim 16 wherein each pair of arms has a curved portion with a centre of curvature which is located in the central region.

18. A dipole box according to claim 16 comprising four or more folded dipoles arranged around the central region.

19. A dipole box according to claim 18 wherein the dipoles are arranged as orthogonally opposed pairs.

20. A dipole box according to claim 19 wherein each pair of dipoles is oriented to radiate at about ±45° polarization with respect to vertical.

* * * * *